US008200497B2

(12) United States Patent
Hardwick

(10) Patent No.: US 8,200,497 B2
(45) Date of Patent: Jun. 12, 2012

(54) SYNTHESIZING/DECODING SPEECH SAMPLES CORRESPONDING TO A VOICING STATE

(75) Inventor: John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

(21) Appl. No.: 12/545,154

(22) Filed: Aug. 21, 2009

(65) Prior Publication Data

US 2010/0088089 A1 Apr. 8, 2010

Related U.S. Application Data

(63) Continuation of application No. 10/046,666, filed on Jan. 16, 2002, now abandoned.

(51) Int. Cl.
*G10L 19/00* (2006.01)
*G10L 11/06* (2006.01)

(52) U.S. Cl. ..... 704/500; 704/201; 704/208; 704/223; 704/501

(58) Field of Classification Search ..... 704/500–504, 704/219–225, 201, 208
See application file for complete search history.

(56) References Cited

U.S. PATENT DOCUMENTS 4,709,390 A * 11/1987 Atal et al. ..... 704/262
4,890,328 A * 12/1989 Prezas et al. ..... 704/223
5,265,167 A * 11/1993 Akamine et al. ..... 704/220
5,327,518 A 7/1994 George
5,479,559 A * 12/1995 Fette et al. ..... 704/207
5,528,727 A * 6/1996 Wang ..... 704/223
5,544,278 A * 8/1996 Bialik et al. ..... 704/268
5,617,507 A * 4/1997 Lee et al. ..... 704/200
5,621,852 A * 4/1997 Lin ..... 704/219
5,701,390 A * 12/1997 Griffin et al. ..... 704/206
5,715,365 A * 2/1998 Griffin et al. ..... 704/214
5,732,389 A * 3/1998 Kroon et al. ..... 704/223
5,752,222 A * 5/1998 Nishiguchi et al. ..... 704/201
5,754,974 A * 5/1998 Griffin et al. ..... 704/206
5,778,335 A * 7/1998 Ubale et al. ..... 704/219

(Continued)

FOREIGN PATENT DOCUMENTS

EP 1 103 955 5/2001

OTHER PUBLICATIONS

Spanias, "Speech coding: a tutorial review", Proceeding of the IEEE, Oct. 1994, pp. 1541-1582.*

(Continued)

*Primary Examiner* — Jialong He
(74) *Attorney, Agent, or Firm* — Fish & Richardson P.C.

(57) ABSTRACT

Synthesizing a set of digital speech samples corresponding to a selected voicing state includes dividing speech model parameters into frames, with a frame of speech model parameters including pitch information, voicing information determining the voicing state in one or more frequency regions, and spectral information. First and second digital filters are computed using, respectively, first and second frames of speech model parameters, with the frequency responses of the digital filters corresponding to the spectral information in frequency regions for which the voicing state equals the selected voicing state. A set of pulse locations are determined, and sets of first and second signal samples are produced using the pulse locations and, respectively, the first and second digital filters. Finally, the sets of first and second signal samples are combined to produce a set of digital speech samples corresponding to the selected voicing state.

85 Claims, 9 Drawing Sheets

U.S. PATENT DOCUMENTS

| | | | | |
|---|---|---|---|---|
| 5,787,398 | A * | 7/1998 | Lowry | 704/268 |
| 5,826,222 | A * | 10/1998 | Griffin | 704/207 |
| 5,953,697 | A * | 9/1999 | Lin et al. | 704/225 |
| 5,963,898 | A * | 10/1999 | Navarro et al. | 704/220 |
| 5,983,173 | A * | 11/1999 | Inoue et al. | 704/219 |
| RE36,721 | E * | 5/2000 | Akamine et al. | 704/220 |
| 6,131,084 | A * | 10/2000 | Hardwick | 704/230 |
| 6,188,980 | B1 * | 2/2001 | Thyssen | 704/230 |
| 6,199,037 | B1 * | 3/2001 | Hardwick | 704/208 |
| 6,240,386 | B1 * | 5/2001 | Thyssen et al. | 704/220 |
| 6,345,255 | B1 * | 2/2002 | Mermelstein | 704/500 |
| 6,351,490 | B1 * | 2/2002 | Serizawa | 375/239 |
| 6,377,916 | B1 * | 4/2002 | Hardwick | 704/208 |
| 6,389,388 | B1 * | 5/2002 | Lin | 704/219 |
| 6,526,378 | B1 * | 2/2003 | Tasaki | 704/224 |
| 6,604,070 | B1 * | 8/2003 | Gao et al. | 704/222 |
| 6,912,495 | B2 * | 6/2005 | Griffin et al. | 704/208 |
| 7,039,581 | B1 * | 5/2006 | Stachurski et al. | 704/205 |
| 7,050,968 | B1 * | 5/2006 | Murashima | 704/208 |
| 7,181,402 | B2 * | 2/2007 | Jax et al. | 704/500 |
| 7,222,070 | B1 * | 5/2007 | Stachurski et al. | 704/207 |
| 2001/0023396 | A1 * | 9/2001 | Gersho et al. | 704/220 |
| 2001/0032079 | A1 * | 10/2001 | Okutani et al. | 704/258 |
| 2002/0062209 | A1 * | 5/2002 | Choi | 704/208 |
| 2002/0147583 | A1 * | 10/2002 | Gao | 704/223 |
| 2003/0050786 | A1 * | 3/2003 | Jax et al. | 704/500 |

OTHER PUBLICATIONS

Cetin et al. "Equiripple FIR filter design by the FFT algorithm", IEEE signal processing magazine, Mar. 1997, pp. 60-64.*

Griffin, "Multi-band excitation vocoder", Technical Report, No. 524, Mar. 1987, Research Lab of Elecgtronics, Massachusetts Institute of Technology.*

Barnwell et al., "Speech Coding: A Computer Laboratory Textbook", John Wiley & Sons, Inc., 1995, pp. 85-90.

Barnwell et al., "Speech Coding: A Computer Laboratory Textbook", John Wiley & Sons, Inc., 1996, pp. 4-7.

T. Dutoit et al., "One the use of a hybrid harmonic/stochastic model for TTS synthesis-by-concatenation," Speech Communication, Elsevier Science Publishers, Amsterdam, NL, vol. 19, No. 2, Aug. 1, 1996, pp. 119-143.

Brandstein et al., "The Multi-Band Excitation Speech Coder," Institute of Electrical and Electronics Engineers, Advances in Speech Coding, Vancouver, Sep. 5-8, 1989, pp. 215-223.

Shlomot et al., "Combined Harmonic and Waveform Coding of Speech at Low Bit Rates," Acoustics, Speech and Signal Processing, 1998, Proceedings of the 1998 IEEE International Conference on Seattle, WA, May 12-15, 1998, pp. 585-588.

European Search Report, Application No. 03250280.9, Nov. 29, 2004, 4 pages.

* cited by examiner

SYNTHESIZING/DECODING SPEECH SAMPLES CORRESPONDING TO A VOICING STATE

CROSS-REFERENCE TO RELATED APPLICATIONS

This application is a continuation of U.S. application Ser. No. 10/046,666, filed Jan. 16, 2002, now pending, which is incorporated by reference.

TECHNICAL FIELD

This invention relates generally to the synthesis of speech and other audio signals

BACKGROUND

Speech encoding and decoding have a large number of applications and have been studied extensively. In general, speech coding, which is also known as speech compression, seeks to reduce the data rate needed to represent a speech signal without substantially reducing the quality or intelligibility of the speech. Speech compression techniques may be implemented by a speech coder, which also may be referred to as a voice coder or vocoder.

A speech coder is generally viewed as including an encoder and a decoder. The encoder produces a compressed stream of bits from a digital representation of speech, such as may be generated at the output of an analog-to-digital converter having as an input an analog signal produced by a microphone. The decoder converts the compressed bit stream into a digital representation of speech that is suitable for playback through a digital-to-analog converter and a speaker. In many applications, the encoder and decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. Recently, low-to-medium rate speech coders operating below 10 kbps have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Speech is generally considered to be a non-stationary signal having signal properties that change over time. This change in signal properties is generally linked to changes made in the properties of a person's vocal tract to produce different sounds. A sound is typically sustained for some short period, typically 10-100 ms, and then the vocal tract is changed again to produce the next sound. The transition between sounds may be slow and continuous or it may be rapid as in the case of a speech "onset". This change in signal properties increases the difficulty of encoding speech at lower bit rates since some sounds are inherently more difficult to encode than others and the speech coder must be able to encode all sounds with reasonable fidelity while preserving the ability to adapt to a transition in the speech signals characteristics. One way to improve the performance of a low-to-medium bit rate speech coder is to allow the bit rate to vary. In variable-bit-rate speech coders, the bit rate for each segment of speech is not fixed, but is allowed to vary between two or more options depending on the signal characteristics. This type of adaption can be applied to many different types of speech coders (or coders for other non-stationary signals, such as audio coders and video coders) with favorable results. Typically, the limitation in a communication system is that the system must be able to handle the different bit rates without interrupting the communications or degrading system performance.

There have been several main approaches for coding speech at low-to-medium data rates. For example, an approach based around linear predictive coding (LPC) attempts to predict each new frame of speech from previous samples using short and long term predictors. The prediction error is typically quantized using one of several approaches of which CELP and/or multi-pulse are two examples. The advantage of the linear prediction method is that it has good time resolution, which is helpful for the coding of unvoiced sounds. In particular, plosives and transients benefit from this in that they are not overly smeared in time. However, linear prediction typically has difficulty for voiced sounds in that the coded speech tends to sound rough or hoarse due to insufficient periodicity in the coded signal. This problem may be more significant at lower data rates that typically require a longer frame size and for which the long-term predictor is less effective at restoring periodicity.

Another leading approach for low-to-medium rate speech coding is a model-based speech coder or vocoder. A vocoder models speech as the response of a system to excitation over short time intervals. Examples of vocoder systems include linear prediction vocoders such as MELP, homomorphic vocoders, channel vocoders, sinusoidal transform coders ("STC"), harmonic vocoders and multiband excitation ("MBE") vocoders. In these vocoders, speech is divided into short segments (typically 10-40 ms), with each segment being characterized by a set of model parameters. These parameters typically represent a few basic elements of each speech segment, such as the segment's pitch, voicing state, and spectral envelope. A vocoder may use one of a number of known representations for each of these parameters. For example, the pitch may be represented as a pitch period, a fundamental frequency or pitch frequency (which is the inverse of the pitch period), or as a long-term prediction delay. Similarly, the voicing state may be represented by one or more voicing metrics, by a voicing probability measure, or by a set of voicing decisions. The spectral envelope is often represented by an all-pole filter response, but also may be represented by a set of spectral magnitudes or other spectral measurements. Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

One vocoder which has been shown to work well for many types of speech is the MBE vocoder which is basically a harmonic vocoder modified to use the Multi-Band Excitation (MBE) model. The MBE vocoder combines a harmonic representation for voiced speech with a flexible, frequency-dependent voicing structure that allows it to produce natural sounding unvoiced speech, and which makes it more robust to the presence of acoustic background noise. These properties allow the MBE model to produce higher quality speech at low to medium data rates and have led to its use in a number of commercial mobile communication applications.

The MBE speech model represents segments of speech using a fundamental frequency corresponding to the pitch, a set of voicing metrics or decisions, and a set of spectral magnitudes corresponding to the frequency response of the vocal tract. The MBE model generalizes the traditional single V/UV decision per segment into a set of decisions, each representing the voicing state within a particular frequency band or region. Each frame is thereby divided into voiced and unvoiced frequency regions. This added flexibility in the voicing model allows the MBE model to better accommodate mixed voicing sounds, such as some voiced fricatives, allows a more accurate representation of speech that has been corrupted by acoustic background noise, and reduces the sensitivity to an error in any one decision. Extensive testing has shown that this generalization results in improved voice quality and intelligibility.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder converts the received bit stream back into individual frames. As part of this conversion, the decoder may perform deinterleaving and error control decoding to correct or detect bit errors. The decoder then uses the frames of bits to reconstruct the MBE model parameters, which the decoder uses to synthesize a speech signal that perceptually resembles the original speech to a high degree.

MBE-based vocoders include the IMBE™ speech coder and the AMBE® speech coder. The AMBE® speech coder was developed as an improvement on earlier MBE-based techniques and includes a more robust method of estimating the excitation parameters (fundamental frequency and voicing decisions). The method is better able to track the variations and noise found in actual speech. The AMBE® speech coder uses a filter bank that typically includes sixteen channels and a non-linearity to produce a set of channel outputs from which the excitation parameters can be reliably estimated. The channel outputs are combined and processed to estimate the fundamental frequency. Thereafter, the channels within each of several (e.g., eight) voicing bands are processed to estimate a voicing decision (or other voicing metrics) for each voicing band.

Most MBE based speech coders employ a two-state voicing model (voiced and unvoiced) and each frequency region is determined to be either voiced or unvoiced. This system uses a set of binary voiced/unvoiced decisions to represent the voicing state of all the frequency regions in a frame of speech. In MBE-based systems, the encoder uses a spectral magnitude to represent the spectral envelope at each harmonic of the estimated fundamental frequency. The encoder then estimates a spectral magnitude for each harmonic frequency. Each harmonic is designated as being either voiced or unvoiced, depending upon the voicing state of the frequency band containing the harmonic. Typically, the spectral magnitudes are estimated independently of the voicing decisions. To do this, the speech encoder computes a fast Fourier transform ("FFT") for each windowed subframe of speech and averages the energy over frequency regions that are multiples of the estimated fundamental frequency. This approach preferably includes compensation to remove from the estimated spectral magnitudes artifacts introduced by the FFT sampling grid.

At the decoder, the received voicing decisions are used to identify the voicing state of each harmonic of the received fundamental frequency. The decoder then synthesizes separate voiced and unvoiced signal components using different procedures. The unvoiced signal component is preferably synthesized using a windowed overlap-add method to filter a white noise signal. The spectral envelope of the filter is determined from the received spectral magnitudes in frequency regions designated as unvoiced, and is set to zero in frequency regions designated as voiced.

Early MBE-based systems estimated phase information at the encoder, quantized this phase information, and included the phase bits in the data received by the decoder. However, one significant improvement incorporated into later MBE-based systems is a phase synthesis method that allows the decoder to regenerate the phase information used in the synthesis of voiced signal components without explicitly requiring any phase information to be transmitted by the encoder. Such phase regeneration methods allow more bits to be allocated to other parameters, allow the bit rate to be reduced, and/or enable shorter frame sizes to thereby increase time resolution. Lower rate MBE vocoders typically use regenerated phase information. One type of phase regeneration is discussed by U.S. Pat. Nos. 5,081,681 and 5,664,051, both of which are incorporated by reference. In this approach, random phase synthesis is used with the amount of randomness depending on the voicing decisions. Alternatively, phase regeneration using minimum phase or using a smoothing kernel applied to the reconstructed spectral magnitudes can be employed. Such phase regeneration is described in U.S. Pat. No. 5,701,390, which is incorporated by reference.

The decoder may synthesize the voiced signal component using one of several methods. For example, a short-time Fourier synthesis method constructs a harmonic spectrum corresponding to a fundamental frequency and the spectral parameters for a particular frame. This spectrum is then converted into a time sequence, either directly or using an inverse FFT, and then combined with similarly-constructed time sequences from neighboring frames using windowed overlap-add. While this approach is relatively straightforward, it sounds distorted for longer (e.g., 20 ms) frame sizes. The source of this distortion is the interference caused by the changing fundamental frequency between neighboring frames. As the fundamental frequency changes, the pitch period alignment changes between the previous and next frames. This causes interference when these misaligned time sequences are combined using overlap-add. For longer frame sizes, this interference causes the synthesized speech to sound rough and distorted.

Another voiced speech synthesizer uses a set of harmonic oscillators, assigns one oscillator to each harmonic of the fundamental frequency, and sums the contributions from all of the oscillators to form the voiced signal component. The instantaneous amplitude and phase of each oscillator is allowed to change according to a low order polynomial (first order for the amplitude, third order for the phase is typical). The polynomial coefficients are computed such that the amplitude, phase and frequency equal the received values for the two frames at the boundaries of the synthesis interval, and the polynomial effectively interpolates these values between the frame boundaries. Each harmonic oscillator matches a single harmonic component between the next and previous frames. The synthesizer uses frequency ordered matching, in which the first oscillator matches the first harmonic between the previous and current frames, the second oscillator matches the second harmonic between the previous and current frames, and so on. Frequency order matching eliminates the interference and resulting distortion as the fundamental frequency slowly changes between frames (even for long frame sizes >20 ms). In a related voiced synthesis method, frequency ordered matching of harmonic components is used in the context of the MBE speech model.

An alternative approach to voiced speech synthesis synthesizes speech as the sum of arbitrary (i.e., not harmonically constrained) sinusoids that are estimated by peak-picking on the original speech spectrum. This method is specifically designed to not use the voicing state (i.e., there are no voiced, unvoiced or other frequency regions), which means that non-harmonic sine waves are important to obtain good quality speech. However, the use of non-harmonic frequencies introduces a number of complications for the synthesis algorithm. For example, simple frequency ordered matching (e.g., first harmonic to first harmonic, second harmonic to second harmonic) is insufficient since the arbitrary sine-wave model is not limited to harmonic frequencies. Instead, a nearest-neighbor matching method that matches a sinusoidal component in one frame to a component in the neighboring frame that is the closest to it in frequency may be used. For example, if the fundamental frequency drops between frames by a factor of two, then the nearest-neighbor matching method allows the first sinusoidal component in one frame to be matched with the second component in the next frame, then the second sinusoidal component may be matched with the fourth, the third sinusoidal component may be matched with the sixth, and so on. This nearest-neighbor approach matches components regardless of any shifts in frequency or spectral energy, but at the cost of higher complexity.

As described, one common method for voiced speech synthesis uses sinusoidal oscillators with polynomial amplitude and phase interpolation to enable production of high quality voiced speech as the voiced speech parameters changes between frames. However, such sinusoidal oscillator methods are generally quite complex because they may match components between frames and because they often compute the contribution for each oscillator separately and for typical telephone bandwidth speech there may be as many as 64 harmonics, or even more in methods that employ non-harmonic sinusoids. In contrast, windowed overlap-add methods do not require any components to be matched between frames, and are computationally much less complex. However, such methods can cause audible distortion, particularly for the longer frame sizes used in low rate coding. A hybrid synthesis method described in U.S. Pat. Nos. 5,195,166 and 5,581,656, which are incorporated by reference, combines these two techniques to produce a method that is computationally simpler than the harmonic oscillator method and which avoids the distortion of the windowed overlap-add method. In this hybrid method, the N lowest frequency harmonics (typically N=7) are synthesized using harmonic oscillators with frequency-ordered matching and polynomial interpolation. All remaining high frequency harmonics are synthesized using an inverse FFT with interpolation and windowed overlap-add. While this method reduces complexity and preserves voice quality, it still requires higher complexity than overlap-add alone because the low-frequency harmonics are still synthesized with harmonic oscillators. In addition, the size of the program that implements this method is increased because this method requires both synthesis methods to be implemented in the decoder.

SUMMARY

In one general aspect, synthesizing a set of digital speech samples corresponding to a selected voicing state includes dividing speech model parameters into frames, with a frame of speech model parameters including pitch information, voicing information determining the voicing state in one or more frequency regions, and spectral information. First and second digital filters are computed using, respectively, first and second frames of speech model parameters, with the frequency responses of the digital filters corresponding to the spectral information in frequency regions for which the voicing state equals the selected voicing state. A set of pulse locations are determined, and sets of first and second signal samples are produced using the pulse locations and, respectively, the first and second digital filters. Finally, the sets of first and second signal samples are combined to produce a set of digital speech samples corresponding to the selected voicing state.

Implementations may include one or more of the following features. For example, the frequency response of the first digital filter and the frequency response of the second digital filter may be zero in frequency regions where the voicing state does not equal the selected voicing state.

The speech model parameters may be generated by decoding a bit stream formed by a speech encoder. The spectral information may include a set of spectral magnitudes representing the speech spectrum at integer multiples of a fundamental frequency.

The voicing information may determine which frequency regions are voiced and which frequency regions are unvoiced. The selected voicing state may be the voiced voicing state, and the pulse locations may be computed such that the time between successive pulse locations is determined at least in part from the pitch information. The selected voicing state may be a pulsed voicing state.

Each pulse location may correspond to a time offset associated with an impulse in an impulse sequence. The first signal samples may be computed by convolving the first digital filter with the impulse sequence, and the second signal samples may be computed by convolving the second digital filter with the impulse sequence. The first signal samples and the second signal samples may be combined by first multiplying each by a synthesis window function and then adding the two together. The first digital filter may be computed as the product of a periodic signal and a pitch-dependent window signal, with the period of the periodic signal being determined from the pitch information for the first frame. The spectrum of the pitch dependent window function may be approximately equal to zero at all non-zero integer multiples of the pitch frequency associated with the first frame.

The first digital filter may be computed by determining FFT coefficients from the decoded model parameters for the first frame in frequency regions where the voicing state equals the selected voicing state, processing the FFT coefficients with an inverse FFT to compute first time-scaled signal samples, interpolating and resampling the first time-scaled signal samples to produce first time-corrected signal samples, and multiplying the first time-corrected signal samples by a window function to produce the first digital filter. Regenerated phase information may be computed using the decoded model parameters for the first frame, and the regenerated phase information may be used in determining the FFT coefficients for frequency regions where the voicing state equals the selected voicing state. For example, the regenerated phase information may be computed by applying a smoothing kernel to the logarithm of the spectral information for the first frame. Further FFT coefficients may be set to approximately zero in frequency regions where the voicing state does not equal the selected voicing state or in frequency regions outside the bandwidth represented by speech model parameters for the first frame.

The window function may depend on the decoded pitch information for the first frame. The spectrum of the window function may be approximately equal to zero at all integer non-zero multiples of the pitch frequency associated with the first frame.

The digital speech samples corresponding to the selected voicing state may be combined with other digital speech samples corresponding to other voicing states.

In another general aspect, decoding digital speech samples corresponding to a selected voicing state from a stream of bits includes dividing the stream of bits into a sequence of frames, each of which contains one or more subframes. Speech model parameters from the stream of bits are decoded for each subframe in a frame, with the decoded speech model parameters including at least pitch information, voicing state information and spectral information. Thereafter, first and second impulse responses are computed from the decoded speech model parameters for a subframe and a previous subframe, with both the first impulse response and the second impulse response corresponding to the selected voicing state. In addition, a set of pulse locations are computed for the subframe, and first and second sets of signal samples are produced from the first and second impulse responses and the pulse locations. Finally, the first signal samples are combined with the second signal samples to produce the digital speech samples for the subframe corresponding to the selected voicing state.

Implementations may include one or more of the features noted above and one or more of the following features. For example, the digital speech samples corresponding to the selected voicing state for the subframe may be further combined with digital speech samples representing other voicing states for the subframe.

The voicing information may include one or more voicing decisions, with each voicing decision determining the voicing state of a frequency region in the subframe. Each voicing decision may determine whether a frequency region in the subframe is voiced or unvoiced, and may further determine whether a frequency region in the subframe is pulsed.

The selected voicing state may be the voiced voicing state and the pulse locations may depend at least in part on the decoded pitch information for the subframe. The frequency responses of the first impulse response and the second impulse response may correspond to the decoded spectral information in voiced frequency regions and may be approximately zero in other frequency regions. Each of the pulse locations may correspond to a time offset associated with each impulse in an impulse sequence, and the first and second signal samples may be computed by convolving the first and second impulse responses with the impulse sequence. The first and second signal samples may be combined by first multiplying each by a synthesis window function and then adding the two together.

The selected voicing state may be the pulsed voicing state, and the frequency response of the first impulse response and the second impulse response may correspond to the spectral information in pulsed frequency regions and may be approximately zero in other frequency regions.

The first impulse response may be computed by determining FFT coefficients for frequency regions where the voicing state equals the selected voicing state from the decoded model parameters for the subframe, processing the FFT coefficients with an inverse FFT to compute first time-scaled signal samples, interpolating and resampling the first time-scaled signal samples to produce first time-corrected signal samples, and multiplying the first time-corrected signal samples by a window function to produce the first impulse response. Interpolating and resampling the first time-scaled signal samples may depend on the decoded pitch information of the first subframe.

Regenerated phase information may be computed using the decoded model parameters for the subframe, and the regenerated phase information may be used in determining the FFT coefficients for frequency regions where the voicing state equals the selected voicing state. The regenerated phase information may be computed by applying a smoothing kernel to the logarithm of the spectral information. Further FFT coefficients may be set to approximately zero in frequency regions where the voicing state does not equal the selected voicing state. Further FFT coefficients also may be set to approximately zero in frequency regions outside the bandwidth represented by decoded model parameters for the subframe.

The window function may depend on the decoded pitch information for the subframe. The spectrum of the window function may be approximately equal to zero at all non-zero multiples of the decoded pitch frequency of the subframe.

The pulse locations may be reinitialized if consecutive frames or subframes are predominately not voiced, such that future determined pulse locations do not substantially depend on speech model parameters corresponding to frames or subframes prior to such reinitialization.

Other features and advantages will be apparent from the following description, including the drawings, and the claims.

DETAILED DESCRIPTION

Figure 1:
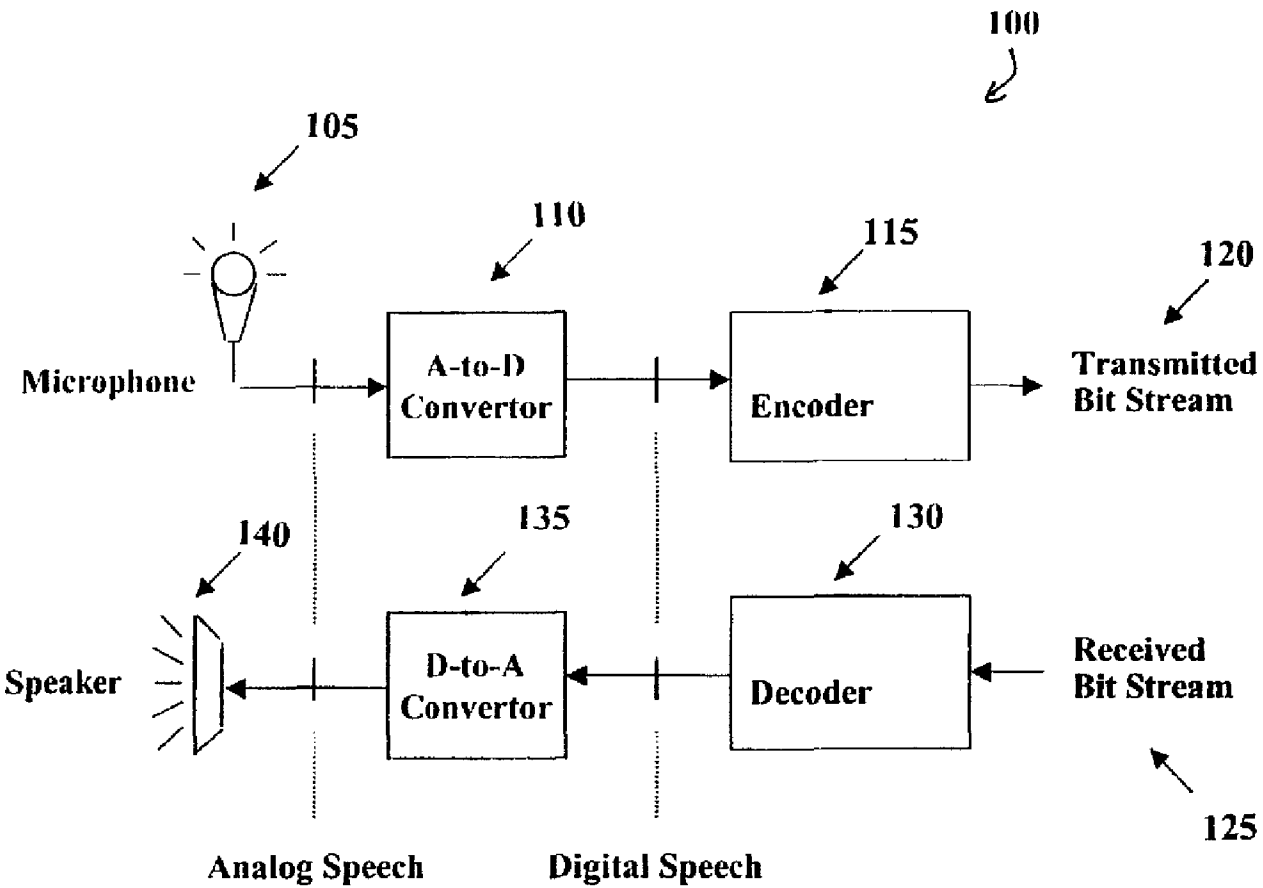
FIG. 1 is a block diagram of a speech coding system including a speech encoder and a speech decoder.

FIG. 1 shows a speech coder or vocoder 100 that samples analog speech or some other signal from a microphone 105. An A-to-D converter 110 digitizes the sampled speech to produce a digital speech signal. The digital speech is processed by a speech encoder unit 115 to produce a digital bit stream 120 suitable for transmission or storage. Typically the speech encoder processes the digital speech signal in short frames, where the frames may be further divided into one or more subframes. Each frame of digital speech samples produces a corresponding frame of bits in the bit stream output of the encoder. Note that if there is only one subframe in the frame, then the frame and subframe typically are equivalent and refer to the same partitioning of the signal. Typical values include two 10 ms subframes in each 20 ms frame, where each 10 ms subframe consists of 80 samples at a 8 kHz sampling rate.

FIG. 1 also depicts a received bit stream 125 entering a speech decoder unit 130 that processes each frame of bits to produce a corresponding frame of synthesized speech samples. A D-to-A converter unit 135 then converts the digital speech samples to an analog signal that can be passed to speaker unit 140 for conversion into an acoustic signal suitable for human listening.

Figure 2:
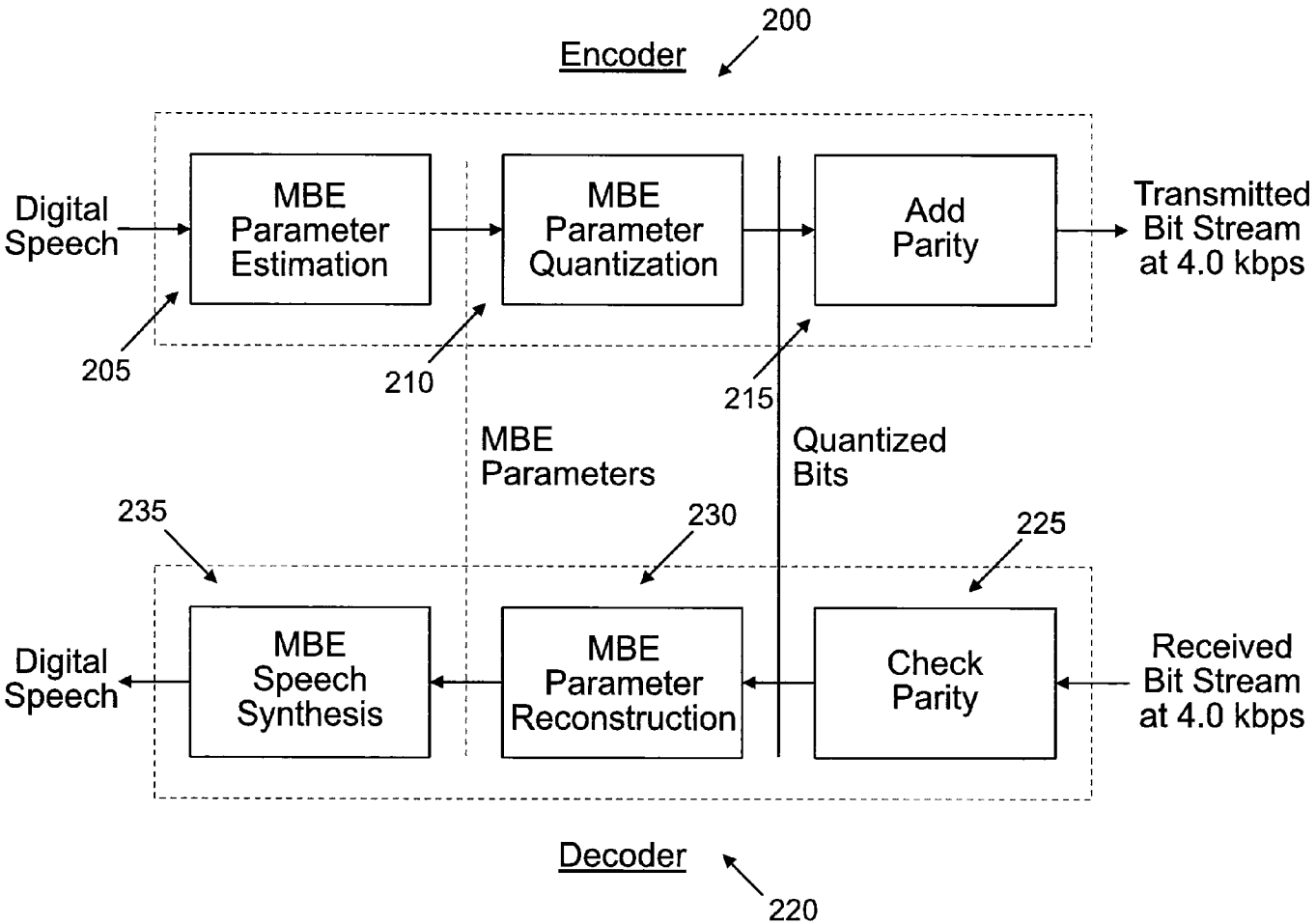
FIG. 2 is a block diagram of a speech encoder and a speech decoder of the system of FIG. 1.

The system may be implemented using a 4 kbps MBE type vocoder which has been shown to provide very high voice quality at a relatively low bit rate. Referring to FIG. 2, the encoder 115 may be implemented using an MBE speech encoder unit 200 that first processes the input digital speech signal with a parameter estimation unit 205 to estimate generalized MBE model parameters for each subframe. These estimated model parameters for a frame are then quantized by a parameter quantization unit 210 to produce parameter bits that are fed to a parity addition unit 215 that combines the quantized bits with redundant parity data to form the transmitted bit stream. The addition of redundant parity data enables the decoder to correct and/or detect bit errors caused by degradation in the transmission channel.

As also shown in FIG. 2, the decoder 130 may be implemented using a 4 kbps MBE speech decoder unit 220 that first processes a frame of bits in the received bit stream with a parity check unit 225 to correct and/or detect bit errors. The parameter bits for the frame are then processed by a parameter reconstruction unit 230 that reconstructs generalized MBE model parameters for each subframe. The resulting model parameters are then used by a speech synthesis unit 235 to produce a synthetic digital speech signal that is the output of the decoder.

In the described 4 kbps MBE type vocoder, 80 bits are used to represent each 20 ms frame, and one bit of the 80 bits is used as a redundant parity check bit. The remaining 79 bits are distributed such that 7 bits quantize the voicing decisions, 9 bits quantize the fundamental frequency (or pitch frequency) parameters, and 63 bits quantize the spectral magnitudes. While this particular implementation is described, the techniques may be readily applied to other speech coding systems that operate at different bit rates or frame sizes, or use a different speech model with alternative parameters (such as STC, MELP, MB-HTC, CELP, HVXC or others). In addition, many types of forward error correction (FEC) can be used to improve the robustness of the system in degraded channels.

The techniques include a variable-bit-rate quantization method that may be used in many different systems and applications. This quantization method allows for operation at different bit rates. For example, operation may be at between 2000-9600 bps. In addition, the method may be implemented in a variable-bit-rate system in which the vocoder bit rate changes from frame to frame in response to changing conditions. For example, the bit rate may be adapted to the speech signal, with more difficult segments using a higher bit rate and less difficult segments using a lower bit rate. This speech signal dependent adaptation, which is related to voice activity detection (VAD), provides higher quality speech at a lower average bit rate.

The vocoder bit rate also can be adapted to changing channel conditions, where a lower bit rate is used for the vocoder when a higher bit error rate is detected on the transmission channel. Similarly, a higher bit rate may be used for the vocoder when fewer bit errors are detected on the transmission channel. This channel-dependent adaptation can provide more robust communication (using adaptive error control or modulation) in mobile or other time-varying channel conditions when error rates are high.

The bit rate also may be adapted to increase system capacity when the demand is high. In this case, the vocoder may use a lower bit rate for calls during the peak demand periods (i.e., when many simultaneous users need to be supported) and use a higher bit rate during low demand periods (i.e., at night) to support fewer users at higher quality. Various other adaption criteria or combinations may be used.

Figure 3:
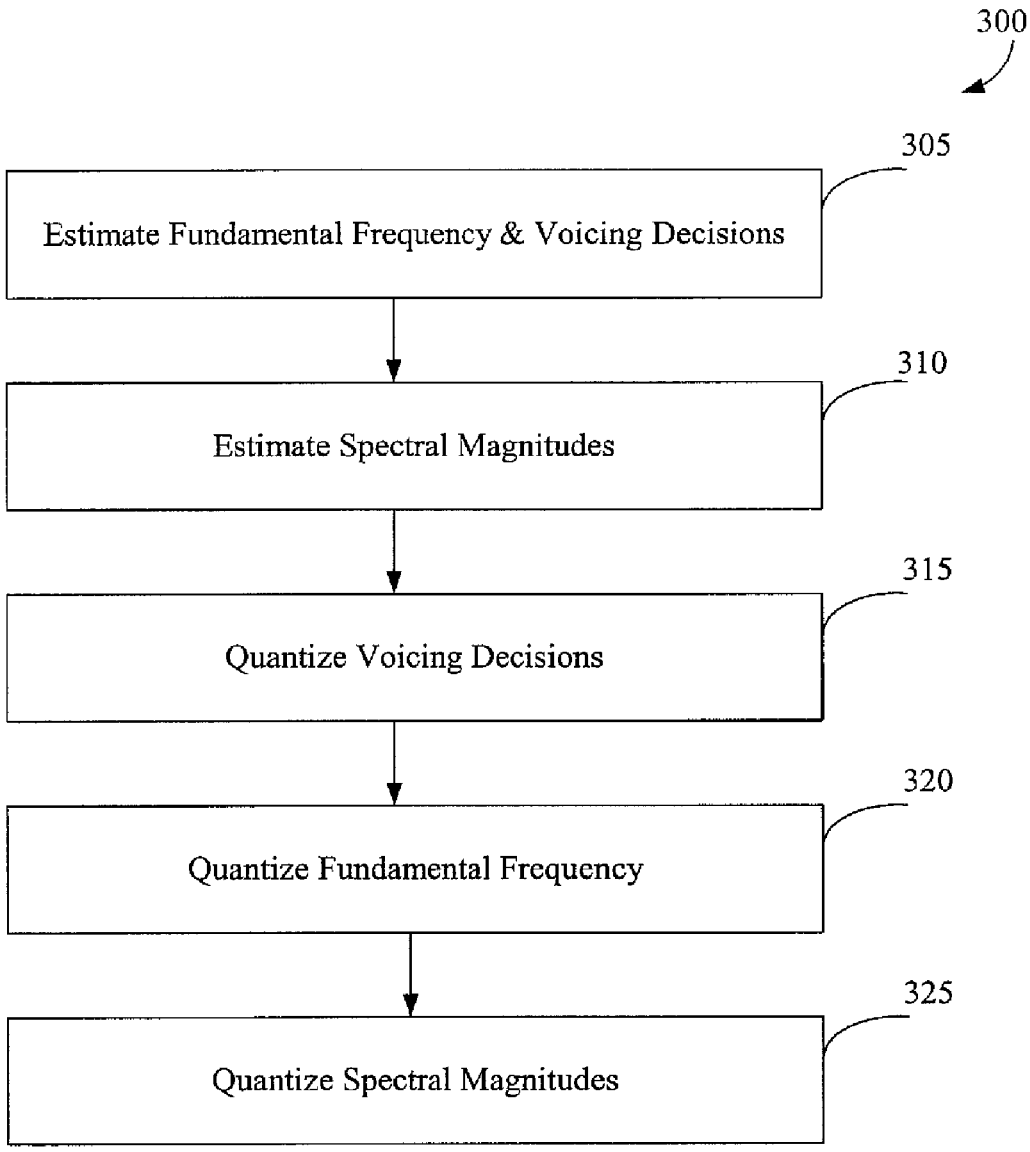
FIGS. 3 and 4 are flow charts of encoding and decoding procedures performed by the encoder and the decoder of FIG. 2.

FIG. 3 illustrates a procedure 300 implemented by the voice encoder. In implementing the procedure 300, the voice encoder estimates a set of generalized MBE model parameters for each subframe from the digital speech signal (steps 305-310). The MBE model used in the described implementation is a three-way voicing model that allows each frequency region to be either voiced, unvoiced, or pulsed. This three-way voicing model improves the ability of the MBE speech model to represent plosives and other sounds, and it significantly improves the perceived voice quality with only a slight increase in bit rate (1-3 bits per frame is typical). This approach uses a set of tertiary valued (i.e., 0, 1 or 2) voicing decisions, where each voicing decision represents the voicing state of a particular frequency region in a frame of speech. The encoder estimates these voicing decisions and may also estimate one or more pulse locations or times for each frame of speech. These parameters, plus the estimated spectral magnitudes and the fundamental frequency, are used by the decoder to synthesize separate voiced, unvoiced and pulsed signal components which are added together to produce the final speech output of the decoder. Note that pulse locations relating to the pulsed signal component may or may not be transmitted to the decoder and in cases where this information is needed but not transmitted, the decoder typically generates a single pulse location at the center of the frame.

The MBE model parameters consist of a fundamental frequency or pitch frequency, a set of tertiary-valued voicing decisions, and a set of spectral magnitudes. Binary-valued voicing decisions can also be employed. The encoder employs a filterbank with a non-linear operator to estimate the fundamental frequency and voicing decisions (step 305), where each subframe is divided into N frequency bands (N=8 is typical) and one voicing decision is estimated per band. The voicing decisions represent the voicing state (i.e., 2=pulsed, 1=voiced, or 0=unvoiced) for each of the N frequency bands covering the bandwidth of interest (approximately 4 kHz for an 8 kHz sampling rate). The estimation of these excitation parameters is discussed in detail in U.S. Pat. Nos. 5,715,365 and 5,826,222, and in co-pending U.S. patent application Ser. No. 09/988,809, filed Nov. 20, 2001, all of which are incorporated by reference.

Once the excitation parameters are estimated, the encoder estimates a set of spectral magnitudes for each subframe (step 310). The spectral magnitudes for each subframe are estimated by windowing the speech signal using a short overlapping window, such as a 155 point modified Kaiser window, and computing an FFT (typically K=256) on the windowed signal. The energy is then summed around each harmonic of the estimated fundamental frequency, and the square root of the sum is the spectral magnitude for that harmonic. One approach to estimating the spectral magnitudes is discussed in U.S. Pat. No. 5,754,974, which is incorporated by reference.

In another implementation, the voicing decisions and fundamental frequency are only estimated once per frame coincident with the last subframe of the current frame and then interpolated for the first subframe of the current frame. Interpolation of the fundamental frequency is accomplished by computing the geometric mean between the estimated fundamental frequency for the current frame and the estimated fundamental frequency for the prior frame. Interpolation of the voicing decisions for each band may be accomplished by a rule that favors voiced, then pulsed, then unvoiced. For example, interpolation can use the rule that if either frame is voiced, then the interpolated value is voiced; otherwise, if either frame is pulsed then the interpolated value is pulsed; otherwise, the interpolated value is unvoiced.

In the described implementation, the encoder quantizes each frame's estimated MBE model parameters (steps 315-325) and the quantized data forms the output bits for that frame. The model parameters are preferably quantized over an entire frame using efficient techniques to jointly quantize the parameters. The voicing decisions may be quantized first since they may influence the bit allocation for the remaining components in the frame. In particular, vector quantization method described in U.S. Pat. No. 6,199,037, which is incorporated by reference, may be used to jointly quantize the voicing decisions with a small number of bits (typically 3-8) (step 315). The method employs a vector codebook that contains voicing state vectors representing probable combinations of tertiary-valued voicing decisions for both subframes in the frame.

The fundamental frequency is typically quantized with 6-16 bits per frame (step 320). In one implementation, the fundamental frequency for the second subframe in the frame is quantized with 7 bits using a scalar log uniform quantizer over a pitch range of approximately 19 to 123 samples. This value is then interpolated with the similarly quantized value from the prior frame, and two additional bits are used to quantize the difference between this interpolated value and the fundamental frequency for the first subframe of the frame. If there are no voiced components in the current frame, then the fundamental frequency for both subframes may be replaced with a default unvoiced value (for example, corresponding to a pitch of 32), and the fundamental frequency bits may be reallocated for other purposes. For example, if the frame contains pulsed signal components, then the pulse locations for one or both subframes may be quantized using these bits. In another variation, these bits may be added to the bits used to quantize the spectral magnitudes to improved the resolution of the magnitude quantizer. Additional information and variations for quantizing the fundamental frequency are disclosed in U.S. Pat. No. 6,199,037, which is incorporated by reference.

Next, the encoder quantizes the two sets of spectral magnitudes per frame (step 325). In one implementation of the 4 kbps vocoder, the encoder converts the spectral magnitudes into the log domain using logarithmic companding and computes the quantized bits then are computed using a combination of prediction, block transforms, and vector quantization. In one implementation, the second log spectral magnitudes (i.e., the log spectral magnitudes for the second subframe) are quantized first and then interpolation is applied between the quantized second log spectral magnitudes for both the current frame and the prior frame. These interpolated amplitudes are subtracted from the first log spectral magnitudes (i.e., the log spectral magnitudes for the first subframe) and the difference is quantized. Knowing both the quantized difference and the second log spectral magnitudes from both the prior frame and the current frame, the decoder can repeat the interpolation, add the difference, and thereby reconstruct the quantized first log spectral magnitudes for the current frame. In one implementation the spectral magnitudes are quantized using the flexible method disclosed in U.S. patent application Ser. No. 09/447,958, filed Nov. 29, 1999, which is incorporated by reference. For the 4 kbps vocoder, 63 bits per frame typically are allocated to quantize the spectral magnitude parameters. Of these bits, 8 bits are used to quantize the mean log spectral magnitude (i.e., the average level or gain term) for the two subframes, and the remaining 55 bits are used to quantize the variation about the mean.

The quantization method can readily accommodate other vocoder bit rates by changing the number of bits allocated to the spectral magnitudes. For example, allocating only 39 bits to the spectral magnitudes plus 6 bits to the fundamental frequency and 3 bits to the voicing decisions yields 48 bits per frame, which is equivalent to 2400 bps at a 20 ms frame size. Time-varying bit rates are achieved by varying the number of bits for different frames in response to the speech signal, the channel condition, the demand, or some combination of these or other factors. In addition, the techniques are readily applicable to other quantization methods and error control such as those disclosed in U.S. Pat. Nos. 6,161,089, 6,131,084, 5,630,011, 5,517,511, 5,491,772, 5,247,579 and 5,226,084, all of which are incorporated by reference.

Figure 4:
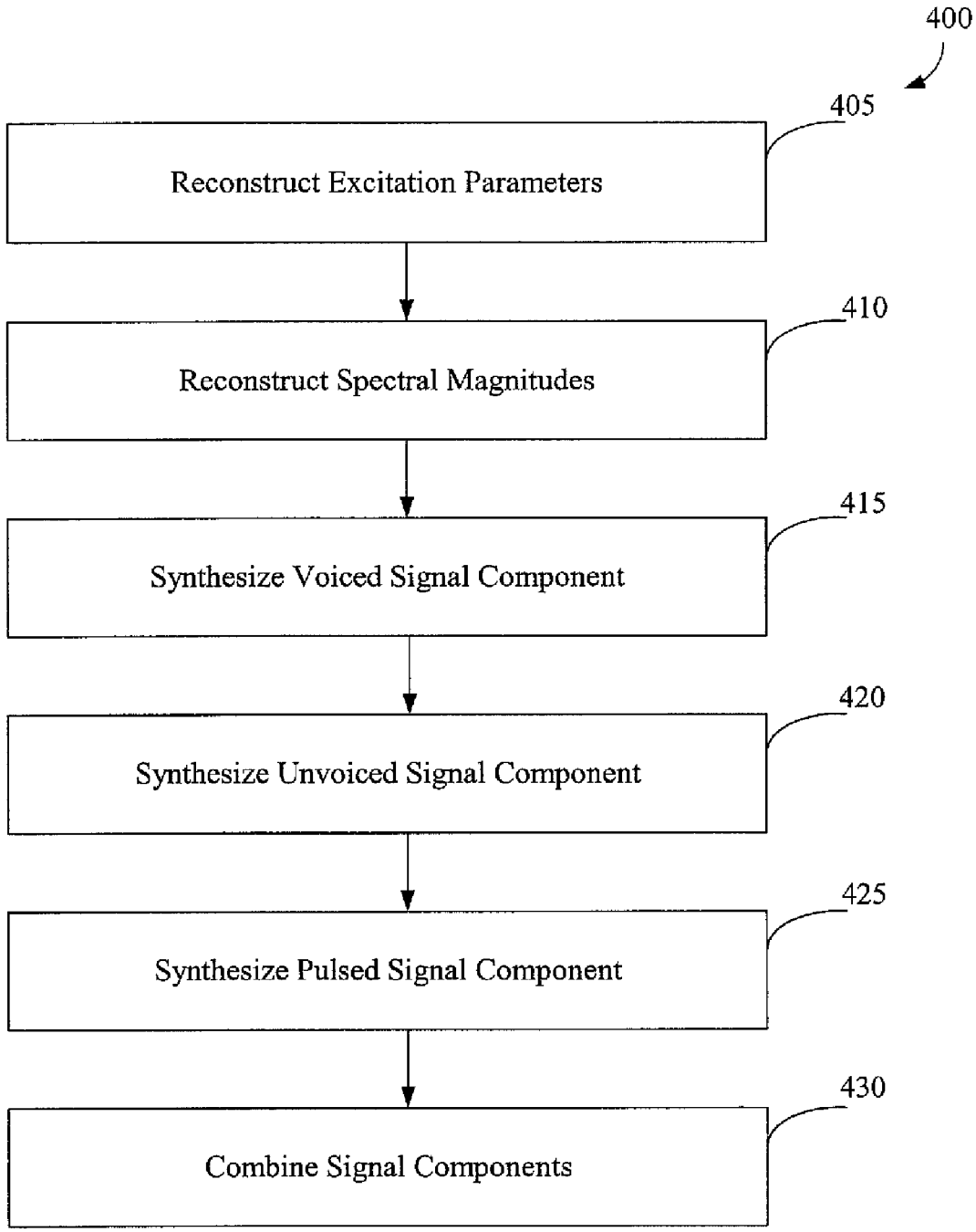

FIG. 4 illustrates a procedure 400 implemented by the decoder, the operation of which is generally the inverse of that of the encoder. The decoder reconstructs the generalized MBE model parameters for each frame from the bits output by the encoder, then synthesizes a frame of speech from the reconstructed information. The decoder first reconstructs the excitation parameters (i.e., the voicing decisions and the fundamental frequencies) for all the subframes in the frame (step 405). When only a single set of voicing decisions and a single fundamental frequency are encoded for the entire frame, the decoder interpolates with the corresponding data received for the prior frame to reconstruct a fundamental frequency and voicing decisions for intermediate subframes in the same manner as the encoder. Also, in the event that the voicing decisions indicate the frame is entirely unvoiced and the option of using no bits to quantize the fundamental frequency in this case has been selected, then the decoder reconstructs the fundamental frequency as the default unvoiced value and reallocates the fundamental bits for other purposes as done by the encoder.

The decoder next reconstructs all the spectral magnitudes (step 410) by inverting the quantization and bit allocation processes used by the encoder and adding in the reconstructed gain term to the log spectral magnitudes. While the techniques can be used with transmitted spectral phase information, in the described implementation, the spectral phases for each subframe, $\theta_l(0)$, are not estimated and transmitted, but are instead regenerated at the decoder, typically using the reconstructed spectral magnitudes, $M_l(0)$, for that subframe. This phase regeneration process produces higher quality speech at low bit rates, since no bits are to required for transmitting the spectral phase information. Such a technique is described in U.S. Pat. No. 5,701,390, which is incorporated by reference.

Figure 5:
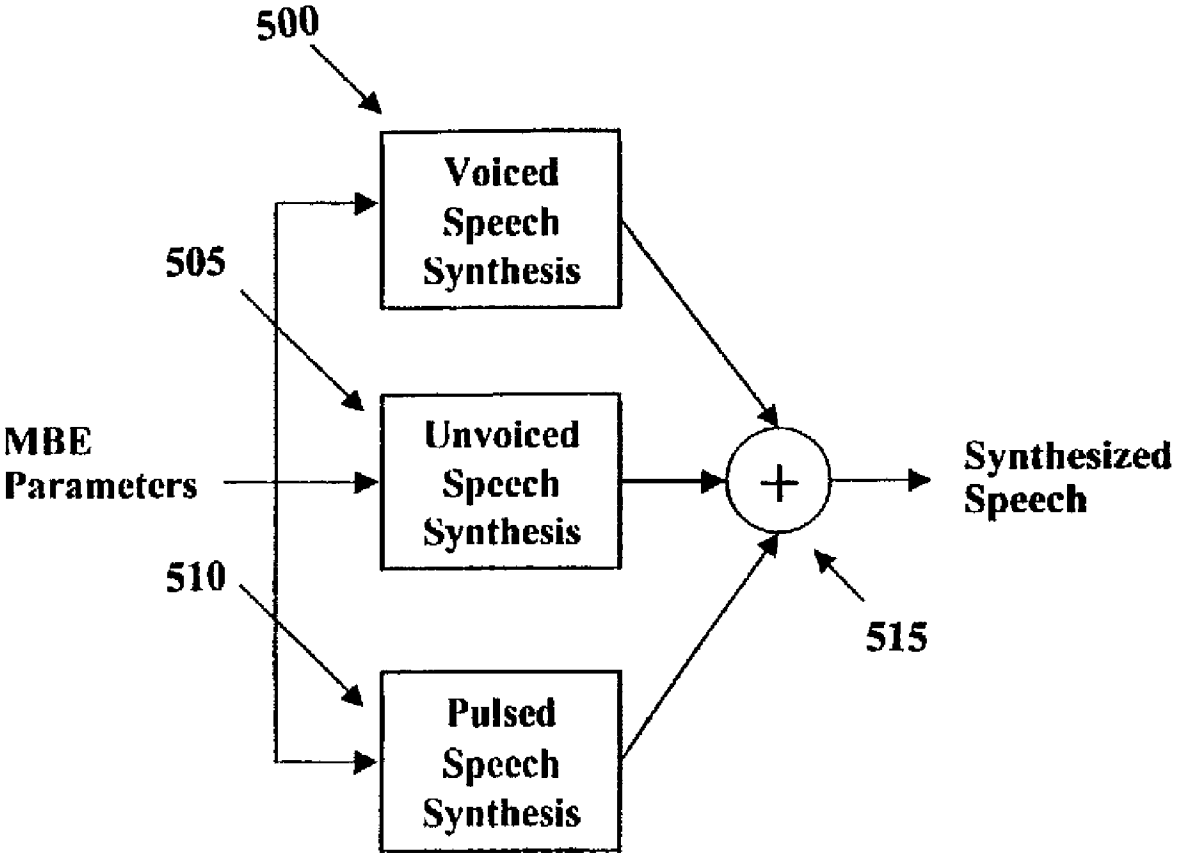
FIG. 5 is a block diagram of a speech synthesizer.

Once the model parameters for the frame are reconstructed, the decoder synthesizes separate voiced (step 415), unvoiced (step 420) and pulsed (step 425) signal components for each subframe, and then adds these components together (step 430) to form the final decoder output for the subframe. Referring to FIG. 5, the model parameters may be input to a voiced synthesizer unit 500, an unvoiced synthesizer unit 505 and a pulsed synthesizer unit 510 to synthesize the voiced, unvoiced and pulsed signal components, respectively. These signals then are combined by a summer 515.

This process is repeated for both subframes in the frame, and is then further applied to a series of consecutive frames to produce a continuous digital speech signal that is output to the D-to-A converter 135 for subsequent playback through the speaker 140. The resulting waveform is perceived by the listener to sound very close to the original speech signal picked up by the microphone and processed by the corresponding encoder.

Figure 6:
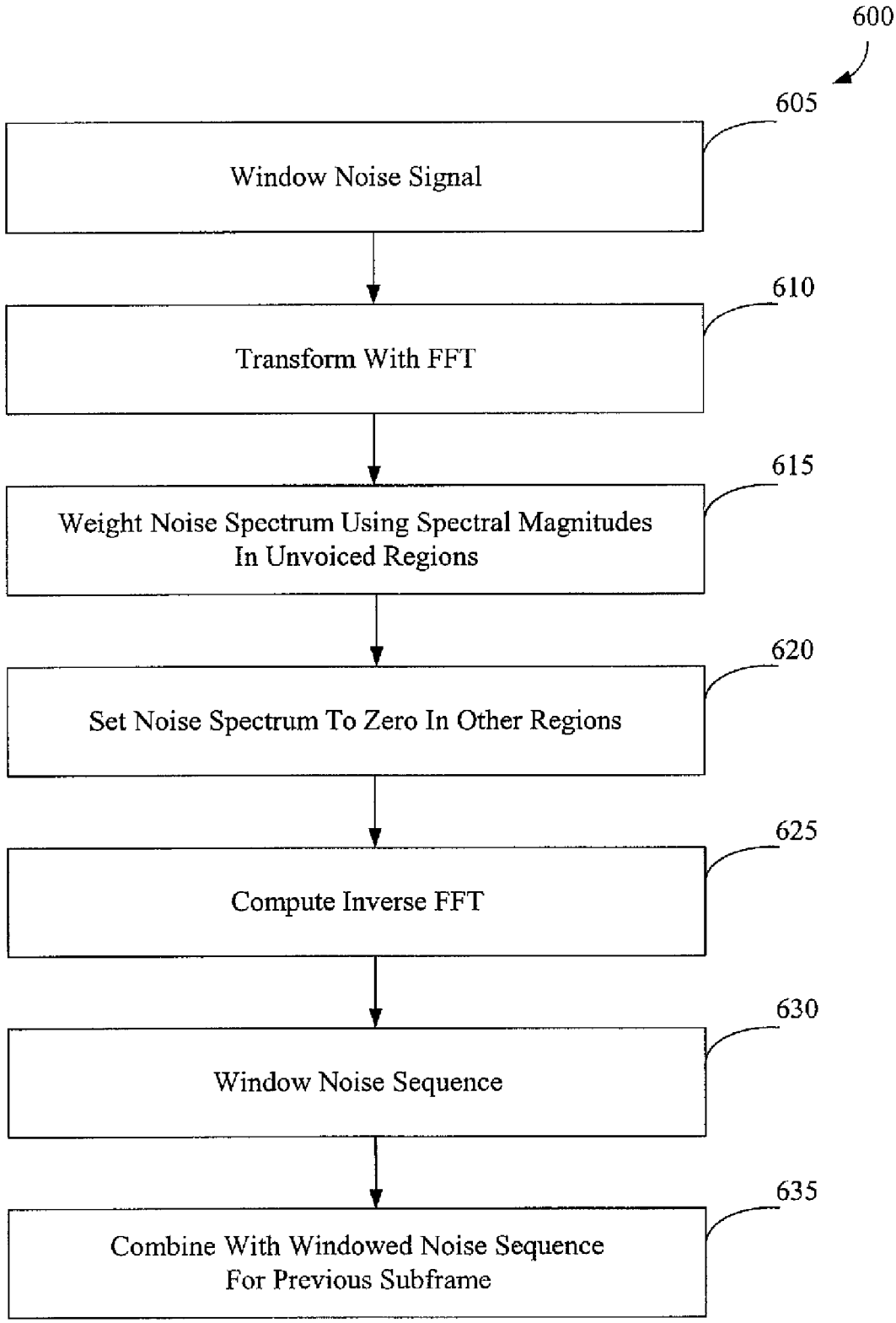
FIGS. 6 and 7 are flow charts of procedures performed by the decoder of FIG. 2 in generating, respectively, an unvoiced signal component and a voiced signal component.

FIG. 6 illustrates a procedure 600 implemented by the decoder in generating the unvoiced signal component is generated using a noise signal. Typically, for each subframe, a white noise signal is windowed (step 605), using a standard window function $w_s(n)$, and then transformed with an FFT to form a noise spectrum (step 610). This noise spectrum is then weighted by the reconstructed spectral magnitudes in unvoiced frequency regions (step 615), while the noise spectrum is set to zero in other frequency regions (step 620). An inverse FFT is computed on the weighted noise spectrum to produce a noise sequence (step 625), and this noise sequence is then windowed again (step 630), typically using the same window function $w_s(n)$, and combined using overlap-add with the noise sequence from typically one previous subframe to produce the unvoiced signal component (step 635).

Figure 7:
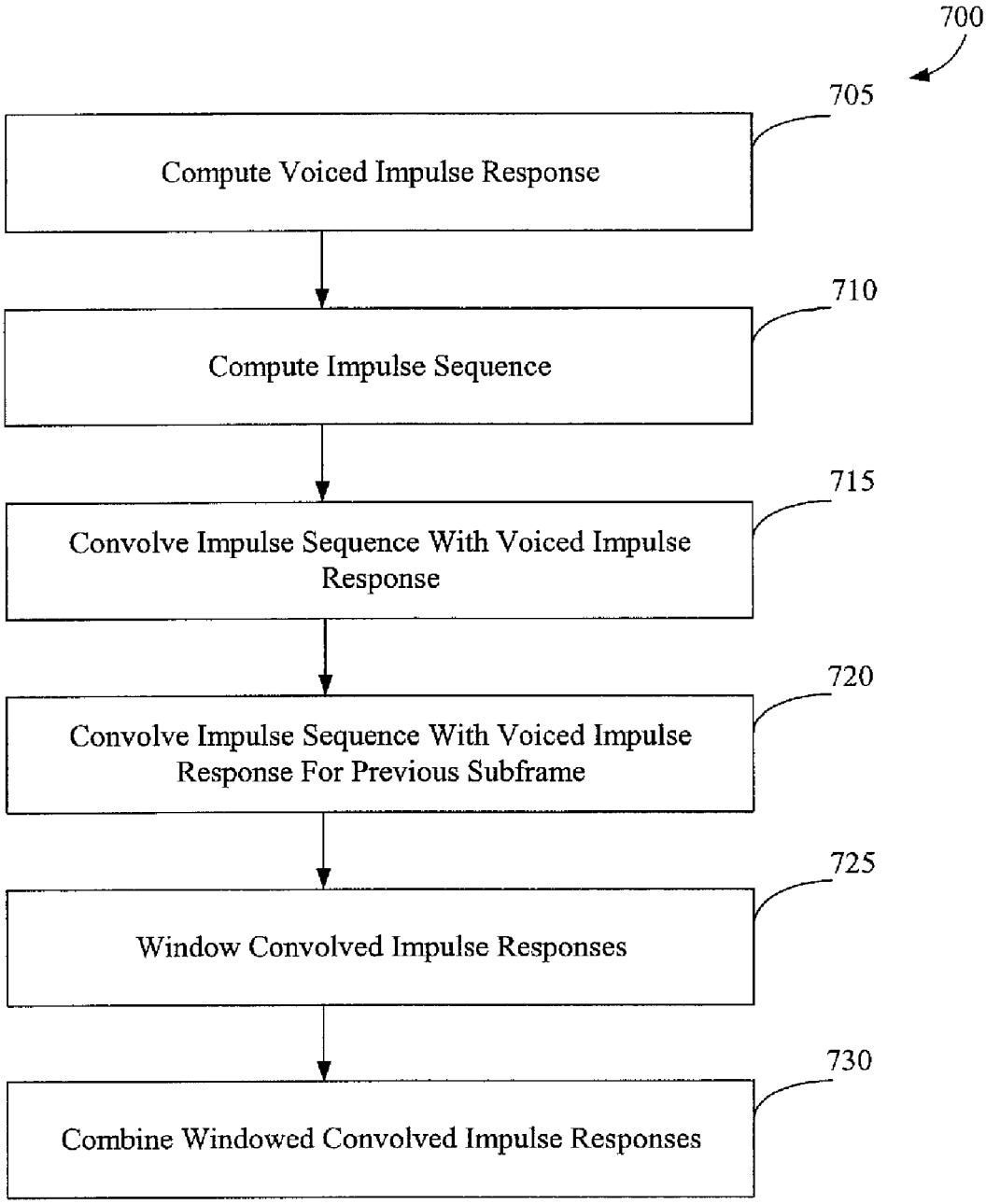

FIG. 7 illustrates a procedure 700 used by the decoder in generating the voiced signal component, which is typically synthesized one subframe at a time with a pitch and spectral envelope determined by the MBE model parameters for that subframe. Generally, a synthesis boundary occurs between each subframe, and the voiced synthesis method must ensure that no audible discontinuities are introduced at these subframe boundaries in order to produce high quality speech. Since the model parameters are generally different between neighboring subframes, some form of interpolation is used to ensure there are no audible discontinuities at the subframe boundaries.

As shown in FIG. 7, the decoder computes a voiced impulse response for the current subframe (step 705). The decoder also computes an impulse sequence for the subframe (710). The decoder then convolves the impulse sequence with the voiced impulse response (step 715) and with the voiced impulse response for the previous subframe (step 720). The convolved impulse responses then are windowed (step 725) and combined (step 730) to produce the voiced signal component.

The new technique for synthesizing the voiced signal component produces high quality speech without discontinuities at the subframe boundaries and has low complexity compared to other techniques. This new technique is also applicable to synthesizing the pulsed signal component and may be used to synthesize both the voiced and pulsed signal components, producing substantial savings in complexity.

The new synthesis technique synthesizes a signal component in intervals or segments that are one subframe in length. Generally, this subframe interval is viewed as spanning the period between the MBE model parameters for the previous subframe and the MBE model parameters for the current subframe. Consequently, the synthesis technique attempts to synthesize a signal component that approximates the model parameters for the previous subframe at the beginning of this interval, while attempting to approximate the model parameters for the current subframe at the end of this interval. Since the MBE model parameters are generally different in the previous and current subframe, the synthesis technique must smoothly transition between the two sets of model parameters without introducing any audible discontinuities at the subframe boundaries, if it is to produce high quality speech.

Considering the voiced signal component, $s_v(n)$, the new synthesis method differs from other techniques in that it does not employ any matching and/or phase synchronization of sinusoidal components. Furthermore, the new synthesis technique does not utilize sinusoidal oscillators with computed amplitude and phase polynomials to interpolate each matched component between neighboring subframes. Instead, the new method applies an impulse and filter approach to synthesize the voiced signal component in the time domain. A voiced impulse response, or digital filter, is computed for each subframe from the MBE model parameters for that subframe. Typically, the voiced impulse response for the current subframe, $H_v(t,0)$, is computed with an FFT independently of the parameters in previous or future subframes. The computed filters are then excited by a sequence of pitch pulses that are positioned to produce high quality speech.

The voiced signal component, $s_v(n)$, may be expressed mathematically as set forth below in Equation [1]. In particular, the decoder computes the voiced impulse responses for the current subframe, $H_v(t,0)$, and combines this response with the voiced impulse response computed for the previous subframe, $H_v(t,-1)$, to produce the voiced signal component, $s_v(n)$, spanning the interval between the current and previous subframes (i.e. $0 \leqq n < N$).

$$s_v(n) = w_s^2(n) \cdot \sum_j H_v(n - t_j, -1) + w_s^2(n - N) \cdot \sum_j H_v(n - t_j, 0) \quad \text{for } 0 \le n < N \qquad [1]$$

The variable N represents the length of the subframe, which is typically equal to 80 samples, although other subframe lengths (for example N=90) are also commonly used. The synthesis window function, $w_s(n)$, is typically the same as that used to synthesize the unvoiced signal component. In one implementation, a square root triangular window function is used as shown in Equation [2], such that the squared window function used in Equation [1] is just a 2N length triangular window.

$$w_s(n) = \begin{cases} \sqrt{(n+N)/N}, & \text{for } -N \le n < 0 \\ \sqrt{(N-n)/N}, & \text{for } 0 \le n < N \\ 0, & \text{otherwise} \end{cases} \qquad (2)$$

Synthesis of the voiced signal component using Equation [1] requires the voiced impulse response for both the current and previous subframe. However, in practice only one voiced impulse response, i.e., that for the current subframe $H_v(t,0)$, is computed. This response then is stored for use in the next subframe, where it represents the voiced impulse response of the previous subframe. Computation of $H_v(t,0)$ is achieved using Equation [3], where $f(0)$, $M_l(0)$, and $\theta_l(0)$ represent, respectively, the fundamental frequency, the spectral magnitude, and the spectral phase model parameters for the current subframe.

$$H_v(t, 0) = w_P(t) \cdot \sum_{l=1}^{L} v_l(0) \cdot M_l(0) \cdot \cos[2\pi \cdot l \cdot f(0) \cdot (t - S) + \theta_l(0)] \qquad [3]$$

The voicing selection parameters $v_l(0)$ in Equation [3] are used to select only the spectral magnitudes for the subframe that occur in frequency regions having the desired voicing state. For synthesizing the voiced signal component, only voiced frequency regions are desired and the voicing selection parameters zero out the spectral magnitudes in unvoiced or pulsed frequency regions. Specifically, if the l'th harmonic frequency, $l \cdot f(0)$, is in a voiced frequency region as determined by the voicing decision for the subframe, then $v_l(0)=1$ and otherwise $v_l(0)=0$. The parameter L represents the number of harmonics (i.e., spectral magnitudes) in the current subframe. Typically, L is computed by dividing the system bandwidth (e.g., 3800 Hz) by the fundamental frequency.

The voiced impulse response $H_v(t,0)$ computed according to Equation [3] can be viewed as a finite length digital filter that uses a pitch dependent window function, $w_P(t)$, which has a non-zero length equal to (P+S) samples, where P is the pitch of the current subframe and is given by P=1/f(0), and where S is a constant controlling the amount of overlap between neighboring pitch periods (typically S=16). Various window functions may be used. However, it is generally desirable for the spectrum of the window function to have a narrow main lobe bandwidth and small sidelobes. It is also desirable for the window to at least approximately meet the constraint expressed in Equation [4].

$$\sum_k w_P(t+k\cdot P)=1 \text{ for all } t \qquad [4]$$

This constraint, which requires the spectrum of the window function to be equal to zero at all non-zero multiples of the fundamental frequency (e.g., f(0), 2 f(0), 3 f(0)), ensures that the spectrum of the impulse response is equal to the value determined by the spectral magnitudes and phases at each harmonic frequency (i.e., each integer multiple of the fundamental frequency). In the described implementation, the window function expressed in Equation [5] is used and meets the constraint of Equation [4].

$$w_P(t)=\begin{cases}\frac{1}{2}\left[1-\cos\left(\frac{\Pi t}{S}\right)\right], & \text{for } 0\le t<S\\ 1, & \text{for } S\le t<P\\ \frac{1}{2}\left[1+\cos\left(\frac{\Pi(t-P)}{S}\right)\right], & \text{for } P\le t<S+P\\ 0, & \text{otherwise}\end{cases} \qquad [5]$$

To compute the voiced signal component according to Equation [1], the pitch pulse locations, $t_j$, must be known. The sequence of pitch pulse locations can be viewed as specifying a set of impulses, $\delta(t_j)$, that are each convolved with the voiced impulse response for both the current and previous subframes through the two summations in Equation [1]. Each summation represents the contribution from one of the subframes (i.e., previous or current) bounding the synthesis interval, and the pitch pulse locations represent the impulse sequence over this interval. Equation [1] combines the contribution from each of these two subframes by multiplying each by a window function, $w_P(t)$, and then summing them to form the voiced signal component over the synthesis interval. Since the window function, $w_P(t)$, is defined in Equation [5] to be zero outside the interval $0\leqq t<(P+S)$, only impulses in the range—$(P+S)\leqq t_j<N$ contribute non-zero terms to the summations in Equation [1]. This results in a relatively small number of terms that must be computed, which reduces the complexity of the new synthesis method.

Generally, the time between successive pitch pulses is approximately equal to the pitch (i.e., $t_{j+1}-t_j\approx P$). However, since the pitch is typically changing between subframes, the time between pitch pulses is typically adjusted in some smooth manner to track the changes in the pitch over the subframe interval. In one implementation, the pitch pulse locations are calculated sequentially using both f(0) and f(−1), where f(−1) denotes the fundamental frequency for the previous subframe. Assuming that the pitch pulse locations $t_j$ for $j\leqq 0$ have all been calculated in prior subframes, then $t_1$, $t_2$, $t_3$, . . . are the pitch pulse locations that must be calculated for the current synthesis interval. These are computed by first using Equations [6] and [7] to compute a variable $\phi(0)$ for the current subframe from a previous variable $\phi(-1)$ computed and stored for the previous subframe.

$$\gamma(0)=\begin{cases}\phi(-1)+\frac{N}{2}[f(0)+f(-1)], & \text{if } C_v(0)\ge 1 \text{ and } C_v(-1)\ge 1\\ \phi(-1)+N\cdot f(-1), & \text{else if } C_v(-1)\ge 1\\ \phi(-1)+N\cdot f(0), & \text{else if } C_v(0)\ge 1\\ 0, & \text{otherwise}\end{cases} \qquad [6]$$

$$\phi(0)=\gamma(0)-\lfloor\gamma(0)\rfloor \qquad [7]$$

The notation $\lfloor x\rfloor$ represents the largest integer less than or equal to x. The variable $C_v(0)$ is the number of harmonics in the current frame that are voiced (i.e., not unvoiced or pulsed), and is limited by the constraint $0\leqq C_v(0)\leqq L$. Similarly, the variable $C_v(-1)$ is the number of harmonics in the previous frame that are voiced, and it is limited by the constraint $0\leqq C_v(-1)\leqq L$. The pitch pulse locations may be computed from these variables using Equation [8].

$$t_j=\begin{cases}\frac{[j-\phi(-1)]}{f(-1)}, & \text{if } C_v(0)=0\\ \frac{[j-\phi(-1)]}{f(0)}, & \text{else if } C_v(-1)=0 \text{ or } f(0)=f(-1)\\ \frac{f(0)\cdot N}{f(0)-f(-1)}\left[1-\sqrt{1-\frac{2\cdot[j-\phi(-1)]\cdot[f(0)-f(-1)]}{f^2(0)\cdot N}}\right], & \text{otherwise}\end{cases} \qquad [8]$$

Equation [8] is applied for non-zero positive integer values of j starting with 1 and proceeding until $t_j\geqq N$ or until any square root term, if applicable, is negative. When either of these two conditions is met, then the computation of pitch pulse locations is stopped and only those pitch pulse locations already computed for the current and previous subframes which are less than N are used in the summations of Equation [1]. Various other methods can be used to compute the pitch pulse locations. For example, the equation $t_j=2\cdot[j-\phi(-1)]/[f(0)+f(1)]$ can be used as a simplified alternative to Equation [8] when $C_v(0)\geqq 1$ and $C_v(-1)$ 1, which sets the spacing between pitch pulses equal to the average pitch over the subframe interval. Note that when the pitch is larger than the synthesis interval, N, there may not be a pitch pulse for the current subframe, while for small pitch periods (P<<N) there are generally many pitch pulses per subframe.

One useful property of the described method for computing the pitch pulses is that the pitch pulse locations are reinitialized whenever $C_v(0)=C_v(-1)=0$, due to the condition $\gamma(0)=0$ in Equation [6]. During the next frame where $C_v(0)\geqq 1$, the pitch pulse locations $t_1$, $t_2$, . . . computed according to Equation [8] will not depend on the fundamental frequency or other model parameters that were decoded for subframes prior to the reinitialization. This ensures that after two or more unvoiced subframes (i.e., all frequency regions in the subframes are unvoiced or pulsed), the pitch pulse locations are reset and do not depend on past parameters. This property makes the technique more deterministic than some previous synthesis methods, where the voiced signal component depended on the infinite past. A resulting advantage is that the system is easier to implement and test.

Figure 8:
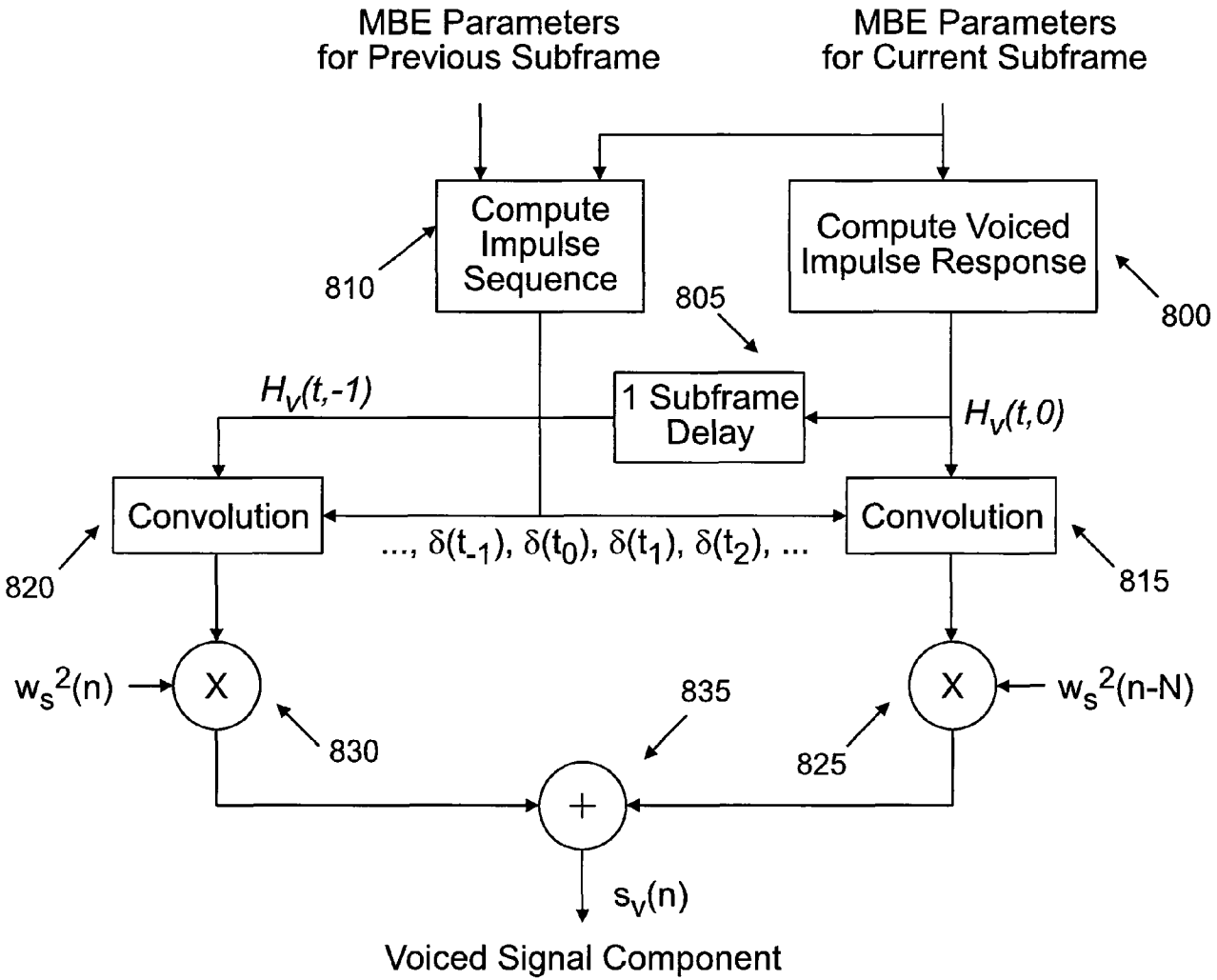
FIG. 8 is a block diagram of a speech synthesis method applied to synthesizing a voiced speech component.

FIG. 8 depicts a block diagram of the new synthesis technique applied to the voiced signal component. The current MBE or other model parameters are input to a voiced impulse response computation unit 800 that outputs the voiced impulse response for the current subframe, $H_v(t,0)$. A delay unit 805 stores the current voiced impulse response for one subframe, and outputs the previous voiced impulse response, $H_v(t,-1)$. An impulse sequence computation unit 810 processes the current and previous model parameters to compute the pitch pulse locations, $t_j$, and the corresponding impulse sequence. Convolution units 815 and 820 then convolve the previous and current voiced impulse responses, respectively, with the computed impulse sequence. The output of the two convolution units are then multiplied by the window functions $w_s^2(n)$ and $w_s^2(n-N)$ using multiplication units 825 and 830, respectively, and the outputs are summed using summation unit 435 to form the voiced signal component, $s_v(n)$.

To compute the voiced signal component according to Equation [1], the voiced impulse response $H_v(t,0)$ must be computed for $t=n-t_j$, for $0 \leqq n < N$ and for all j such that—$(P+S) \leqq t_j < N$. This can be done in a straightforward manner using Equation [3] once the pitch pulse locations $t_j$ have been computed. However, the complexity of this approach may be too high for some applications. A more efficient method is to first compute a time scaled impulse response $G_v(k,0)$, using a K length inverse FFT algorithm as shown in Equation [9]:

$$G_v(k,0) = \sum_{l=1}^{L} v_l(0) \cdot M_l(0) \cdot \exp\{j \cdot [\theta_l(0) - 2\pi \cdot l \cdot f(0) \cdot S]\} \exp\left\{\frac{2\pi \cdot l \cdot k}{K}\right\} \quad [9]$$

where K=256 is a typical inverse FFT length. Note that the summation in Equation [9] is expressed with only L non-zero terms covering the range $1 \leqq l \leqq L$. However, since $L < K-1$, the summation can also be expressed in the standard inverse FFT form over the range $0 \leqq l \leqq K-1$ where the terms for l=0 and l>L are simply equal to zero. Once $G_b(k,0)$ is computed, the required voiced impulse response $H_v(n-t_j, 0)$ can be computed for the required values of n and $t_j$ by interpolating and resampling $G_v(k,0)$ according to Equations [10] and [11]. Typically, linear interpolation is used as shown in Equation [11]. However, other forms of interpolation can be used. Note that for longer FFT lengths (i.e., K>>L) linear or other lower order interpolation is sufficient for high quality synthesis. However, for shorter FFT lengths (i.e. K≈L) higher order interpolation may be needed to produce high quality speech. In practice, an FFT length (K=256) with linear interpolation has been found to produce good results with only modest complexity. Also note that when applying interpolation as shown in Equation [11], $G_v(k,0)$ may be viewed as a periodic sequence with period K, i.e. $G_v(k,0)=G_v(k+pK,0)$ for all p.

$$k_v = \lfloor K \cdot f(0) \cdot t \rfloor \quad [10]$$

$$H_v(t,0) = [(1 + k_l - K \cdot f(0) \cdot t) \cdot G_v(k_l,0) + (K \cdot f(0) \cdot t - k_l) \cdot G_v(k_l+1, 0)] \cdot w_P(t) \quad [11]$$

The synthesis procedure described is Equations [1]-[11] is repeated for consecutive subframes to produce the voiced signal component corresponding to each subframe. After synthesizing the voiced signal component for one subframe, all existing pitch pulse locations, $t_j$, are modified by subtracting, N, which is the subframe length, and then reindexing them such that the last known pitch pulse location is referenced as $t_0$. These modified and reindexed pitch pulse locations are then stored for use in synthesizing the voiced signal component for the next subframes. Note that only modified pitch pulse locations for which $t_j \geqq -(P_{max}+S)$, where $P_{max}$ is the maximum decoder pitch period, need to be stored for use in the next subframe(s), and all other pitch pulse locations can be discarded since they are not used in subsequent subframes. $P_{max}=123$ is typical.

Figure 9:
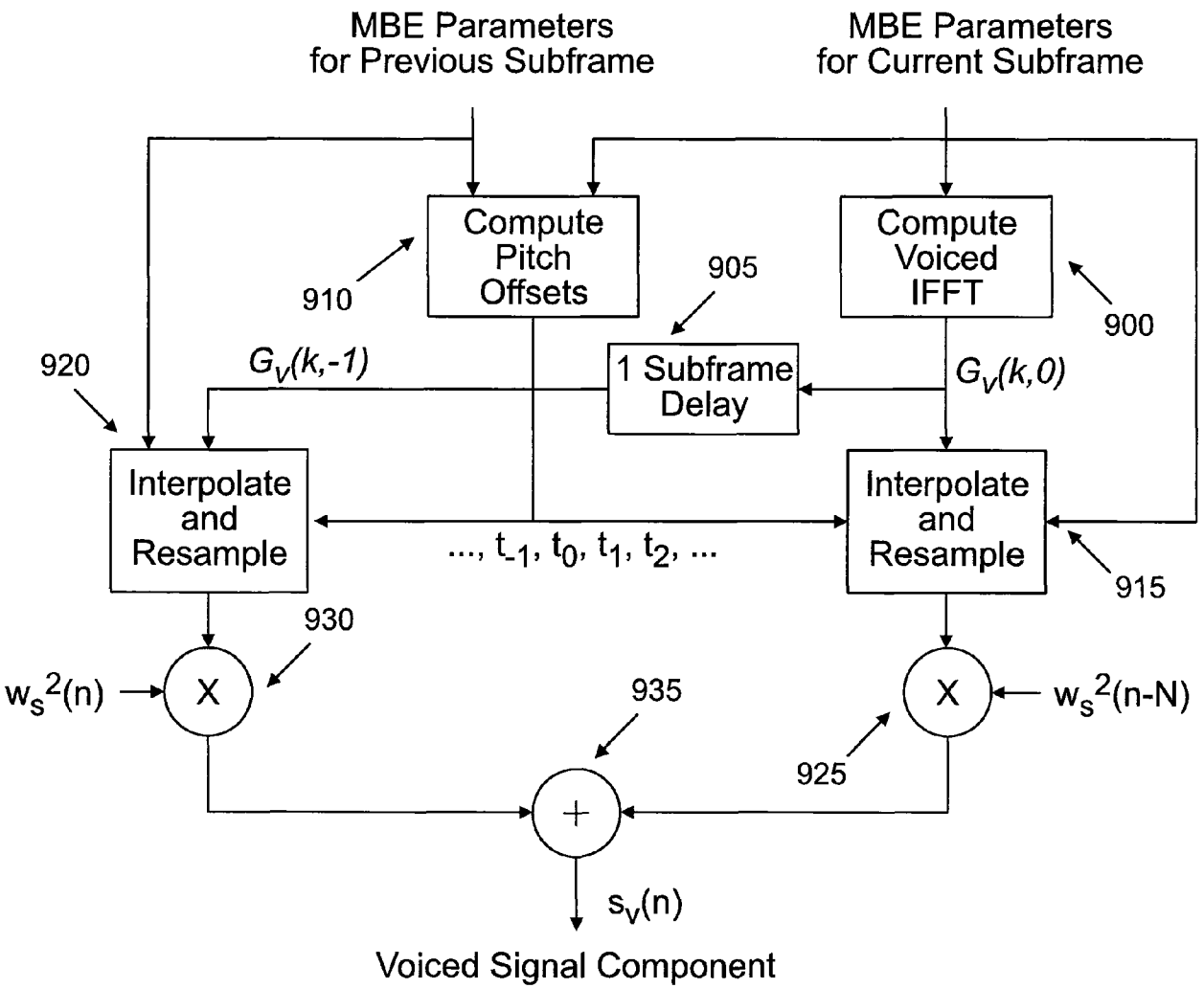
FIG. 9 is a block diagram of an FFT-based speech synthesis method applied to synthesizing a voiced speech component.

FIG. 9 depicts a block diagram of the new voiced synthesis method using a computationally efficient inverse FFT. The current MBE model parameters are input to a processing unit 900 which computes an inverse FFT from the selected voiced harmonics and outputs the current time scaled voiced impulse response, $G_v(k,0)$. A delay unit 905 stores this computed time scaled voiced impulse response for one subframe, and outputs the previous time scaled voiced impulse response, $G_v(k,-1)$. A pitch pulse computation unit 910 processes the current and previous model parameters to compute the pitch pulse locations, $t_j$, which specify the pitch pulses for the voiced signal component over the synthesis interval. Combined interpolation and resampling units 915 and 920, then interpolate and resample the previous and current time scaled voiced impulse responses, respectively, to perform time scale correction, depending on the pitch of each subframe and the inverse FFT size. The outputs of these two unit are then multiplied by the window functions $w_s^2(n)$ and $w_s^2(n-N)$ using multiplication units 925 and 930, respectively, and the outputs are summed using summation unit 935 to form the voiced signal component, $s_v(n)$.

The synthesis procedure described is Equations [1]-[11] is useful for synthesizing any signal component which can be represented as the response of a digital filter (i.e., an impulse response) to some number of impulses. Since the voiced signal component can be viewed as a quasi-periodic set of impulses driving a digital filter, the new method can be used to synthesize the voiced signal component as described above. The new method is also very useful for synthesizing the pulsed signal component, which also can be viewed as a digital filter excited by one or more impulses. In the described implementation, one pulse is used per subframe for the pulsed signal component. The pulse location, $t_p$, can either be set to an known pulse location ($t_p=0$ is typical) or, if sufficient bits are available, the best pulse location can be estimated and quantized at the encoder and reconstructed by the decoder from the received bit stream. In the described implementation, the pulse location for both subframes in a frame are quantized with 9 bits, in place of the fundamental frequency, if there are no voiced regions in either subframe, and 22 level uniform quantization over the range—$65 < t_p < 65$ is used. If there is some voiced region, then no bits are allocated to quantize the pulse location and a default pulse location $t_p=0$ is used. Many variations on this concept may be employed. For example, more than one pulse per subframe can be used and optionally each pulse can have a separate amplitude.

The synthesis for the pulsed signal component is very similar to the synthesis for the voiced signal component except that there is typically only one pulse location per subframe corresponding to the time offset of the desired pulse. Note that in the variation where more than one pulse per subframe was used, there would be one pulse location per pulse. The voicing selection parameters $v_l(0)$ in Equations [3] and [9] are also modified to select only the pulsed frequency regions while zeroing out spectral magnitudes in unvoiced or voiced frequency regions. Specifically, if the l'th harmonic frequency, $l \cdot f(0)$, is in a pulsed frequency region as determined by the voicing decision for the subframe, then $v_l(0)=1$. For all other, i.e. voiced or unvoiced, frequency regions, $v_l(0)$ =0. The remainder of the process for synthesizing the pulsed signal component proceeds in a manner similar to the voiced signal component described above.

Other implementations are within the scope of the following claims.

What is claimed is:

1. A method of synthesizing a set of digital speech samples corresponding to a selected voicing state from speech model parameters, the method comprising the steps of:

dividing the speech model parameters into frames, wherein a frame of speech model parameters includes pitch information, voicing information determining the voicing state in one or more frequency regions, and spectral information;

computing a first digital filter using a first frame of speech model parameters, wherein the frequency response of the first digital filter corresponds to the spectral information in frequency regions where the voicing state equals the selected voicing state;

computing a second digital filter using a second frame of speech model parameters, wherein the frequency response of the second digital filter corresponds to the spectral information in frequency regions where the voicing state equals the selected voicing state;

determining a set of pulse locations;

producing a set of first signal samples from the first digital filter and the pulse locations;

producing a set of second signal samples from the second digital filter and the pulse locations;

combining the first signal samples with the second signal samples to produce a set of digital speech samples corresponding to the selected voicing state;

using the set of digital speech samples corresponding to the selected voicing state to produce speech samples of a digital speech signal;

providing the speech samples of the digital speech signal to a digital-to-analog converter that converts the speech samples of the digital speech signal to an analog signal; and providing the analog signal to a speaker that converts the analog signal into an acoustic signal suitable for human listening.

2. The method of claim 1 wherein the frequency response of the first digital filter and the frequency response of the second digital filter are zero in frequency regions where the voicing state does not equal the selected voicing state.

3. The method of claim 2 wherein the spectral information includes a set of spectral magnitudes representing the speech spectrum at integer multiples of a fundamental frequency.

4. The method of claim 2 wherein the speech model parameters are generated by decoding a bit stream formed by a speech encoder.

5. The method of claim 2 wherein the voicing information determines which frequency regions are voiced and which frequency regions are unvoiced.

6. The method of claim 5 wherein the selected voicing state is the voiced voicing state and the pulse locations are computed such that the time between successive pulse locations is determined at least in part from the pitch information.

7. The method of claim 6 wherein the pulse locations are reinitialized if consecutive frames or subframes are predominately not voiced, and future determined pulse locations do not substantially depend on speech model parameters corresponding to frames or subframes prior to such reinitialization.

8. The method of claim 5 wherein the first digital filter is computed as the product of a periodic signal and a pitch-dependent window signal, and the period of the periodic signal is determined from the pitch information for the first frame.

9. The method of claim 8 wherein the spectrum of the pitch dependent window function is approximately equal to zero at all non-zero integer multiples of the pitch frequency associated with the first frame.

10. The method of claim 5 wherein the first digital filter is computed by:

determining FFT coefficients from the decoded model parameters for the first frame in frequency regions where the voicing state equals the selected voicing state;

processing the FFT coefficients with an inverse FFT to compute first time-scaled signal samples;

interpolating and resampling the first time-scaled signal samples to produce first time-corrected signal samples; and multiplying the first time-corrected signal samples by a window function to produce the first digital filter.

11. The method of claim 10 wherein regenerated phase information is computed using the decoded model parameters for the first frame, and the regenerated phase information is used in determining the FFT coefficients for frequency regions where the voicing state equals the selected voicing state.

12. The method of claim 11 wherein the regenerated phase information is computed by applying a smoothing kernel to the logarithm of the spectral information for the first frame.

13. The method of claim 11 wherein further FFT coefficients are set to approximately zero in frequency regions where the voicing state does not equal the selected voicing state or in frequency regions outside the bandwidth represented by speech model parameters for the first frame.

14. The method of claim 10 wherein the window function depends on the decoded pitch information for the first frame.

15. The method of claim 14 wherein the spectrum of the window function is approximately equal to zero at all integer non-zero multiples of the pitch frequency associated with the first frame.

16. The method of claim 2 wherein the selected voicing state is a pulsed voicing state.

17. The method of claim 16 wherein the first digital filter is computed as the product of a periodic signal and a pitch-dependent window signal, and the period of the periodic signal is determined from the pitch information for the first frame.

18. The method of claim 17 wherein the spectrum of the pitch dependent window function is approximately equal to zero at all non-zero integer multiples of the pitch frequency associated with the first frame.

19. The method of claim 16 wherein the first digital filter is computed by:

determining FFT coefficients from the decoded model parameters for the first frame in frequency regions where the voicing state equals the selected voicing state;

processing the FFT coefficients with an inverse FFT to compute first time-scaled signal samples;

interpolating and resampling the first time-scaled signal samples to produce first time-corrected signal samples; and multiplying the first time-corrected signal samples by a window function to produce the first digital filter.

20. The method of claim 19 wherein regenerated phase information is computed using the decoded model parameters for the first frame, and the regenerated phase information is used in determining the FFT coefficients for frequency regions where the voicing state equals the selected voicing state.

21. The method of claim 20 wherein the regenerated phase information is computed by applying a smoothing kernel to the logarithm of the spectral information for the first frame.

22. The method of claim 20 wherein further FFT coefficients are set to approximately zero in frequency regions where the voicing state does not equal the selected voicing state or in frequency regions outside the bandwidth represented by speech model parameters for the first frame.

23. The method of claim 19 wherein the window function depends on the decoded pitch information for the first frame.

24. The method of claim 23 wherein the spectrum of the window function is approximately equal to zero at all integer non-zero multiples of the pitch frequency associated with the first frame.

25. The method of claim 2 wherein each pulse location corresponds to a time offset associated with an impulse in an impulse sequence, the first signal samples are computed by convolving the first digital filter with the impulse sequence, and the second signal samples are computed by convolving the second digital filter with the impulse sequence.

26. The method of claim 25 wherein the first signal samples and the second signal samples are combined by first multiplying each by a synthesis window function and then adding the two together.

27. The method of claim 1 wherein the spectral information includes a set of spectral magnitudes representing the speech spectrum at integer multiples of a fundamental frequency.

28. The method of claim 1 wherein the speech model parameters are generated by decoding a bit stream formed by a speech encoder.

29. The method of claim 1 wherein the first digital filter is computed as the product of a periodic signal and a pitch-dependent window signal, and the period of the periodic signal is determined from the pitch information for the first frame.

30. The method of claim 29 wherein the spectrum of the pitch dependent window function is approximately equal to zero at all non-zero integer multiples of the pitch frequency associated with the first frame.

31. The method of claim 1 wherein the first digital filter is computed by:

determining FFT coefficients from the decoded model parameters for the first frame in frequency regions where the voicing state equals the selected voicing state;

processing the FFT coefficients with an inverse FFT to compute first time-scaled signal samples;

interpolating and resampling the first time-scaled signal samples to produce first time-corrected signal samples; and multiplying the first time-corrected signal samples by a window function to produce the first digital filter.

32. The method of claim 31 wherein regenerated phase information is computed using the decoded model parameters for the first frame, and the regenerated phase information is used in determining the FFT coefficients for frequency regions where the voicing state equals the selected voicing state.

33. The method of claim 32 wherein the regenerated phase information is computed by applying a smoothing kernel to the logarithm of the spectral information for the first frame.

34. The method of claim 32 wherein further FFT coefficients are set to approximately zero in frequency regions where the voicing state does not equal the selected voicing state or in frequency regions outside the bandwidth represented by speech model parameters for the first frame.

35. The method of claim 31 wherein the window function depends on the decoded pitch information for the first frame.

36. The method of claim 35 wherein the spectrum of the window function is approximately equal to zero at all integer non-zero multiples of the pitch frequency associated with the first frame.

37. The method of claim 1 wherein the digital speech samples corresponding to the selected voicing state are further combined with other digital speech samples corresponding to other voicing states.

38. A method of decoding digital speech samples corresponding to a selected voicing state from a stream of bits, the method comprising:

dividing the stream of bits into a sequence of frames, wherein each frame contains one or more subframes;

decoding speech model parameters from the stream of bits for each subframe in a frame, the decoded speech model parameters including at least pitch information, voicing state information and spectral information;

computing a first impulse response from the decoded speech model parameters for a subframe and computing a second impulse response from the decoded speech model parameters for a previous subframe, wherein both the first impulse response and the second impulse response correspond to the selected voicing state;

computing a set of pulse locations for the subframe;

producing a set of first signal samples from the first impulse response and the pulse locations;

producing a set of second signal samples from the second impulse response and the pulse locations;

combining the first signal samples with the second signal samples to produce the digital speech samples for the subframe corresponding to the selected voicing state;

using the digital speech samples for the subframe corresponding to the selected voicing state to produce speech samples of a digital speech signal;

providing the speech samples of the digital speech signal to a digital-to-analog converter that converts the speech samples of the digital speech signal to an analog signal; and providing the analog signal to a speaker that converts the analog signal into an acoustic signal suitable for human listening.

39. The method of claim 38 wherein the digital speech samples for the subframe corresponding to the selected voicing state are further combined with digital speech samples for the subframe representing other voicing states.

40. The method of claim 39 wherein the voicing state information includes one or more voicing decisions, with each voicing decision determining the voicing state of a frequency region in the subframe.

41. The method of claim 40 wherein each voicing decision determines whether a frequency region in the subframe is voiced or unvoiced.

42. The method of claim 41 wherein the pulse locations are reinitialized if consecutive frames or subframes are predominately not voiced, and future determined pulse locations do not substantially depend on speech model parameters corresponding to frames or subframes prior to such reinitialization.

43. The method of claim 41 wherein each voicing decision further determines whether a frequency region in the subframe is pulsed.

44. The method of claim 41 wherein the selected voicing state is the voiced voicing state and the pulse locations depend at least in part on the decoded pitch information for the subframe.

45. The method of claim 44 wherein the pulse locations are reinitialized if consecutive frames or subframes are predominately not voiced, and future determined pulse locations do not substantially depend on speech model parameters corresponding to frames or subframes prior to such reinitialization.

46. The method of claim 45 wherein frequency responses of the first impulse response and the second impulse response correspond to the decoded spectral information in voiced frequency regions and the frequency responses are approximately zero in other frequency regions.

47. The method of claim 46 wherein each of the pulse locations corresponds to a time offset associated with each impulse in an impulse sequence, and the first signal samples are computed by convolving the first impulse response with the impulse sequence and the second signal samples are computed by convolving the second impulse response with the impulse sequence.

48. The method of claim 47 wherein the first signal samples and the second signal samples are combined by first multiplying each by a synthesis window function and then adding the two together.

49. The method of claim 43 wherein the selected voicing state is the pulsed voicing state, and the frequency response of the first impulse response and the second impulse response corresponds to the spectral information in pulsed frequency regions and the frequency response is approximately zero in other frequency regions.

50. The method of claim 43 wherein the first impulse response is computed by:

determining FFT coefficients for frequency regions where the voicing state equals the selected voicing state from the decoded model parameters for the subframe;

processing the FFT coefficients with an inverse FFT to compute first time-scaled signal samples;

interpolating and resampling the first time-scaled signal samples to produce first time-corrected signal samples; and multiplying the first time-corrected signal samples by a window function to produce the first impulse response.

51. The method of claim 50 wherein the interpolating and resampling the first time-scaled signal samples depends on the decoded pitch information of the first subframe.

52. The method of claim 51 wherein the pulse locations are reinitialized if consecutive frames or subframes are predominately not voiced, and future determined pulse locations do not substantially depend on speech model parameters corresponding to frames or subframes prior to such reinitialization.

53. The method of claim 51 wherein regenerated phase information is computed using the decoded model parameters for the subframe, and the regenerated phase information is used in determining the FFT coefficients for frequency regions where the voicing state equals the selected voicing state.

54. The method of claim 53 wherein the regenerated phase information is computed by applying a smoothing kernel to the logarithm of the spectral information.

55. The method of claim 53 wherein further FFT coefficients are set to approximately zero in frequency regions where the voicing state does not equal the selected voicing state.

56. The method of claim 55 wherein further FFT coefficients are set to approximately zero in frequency regions outside the bandwidth represented by decoded model parameters for the subframe.

57. The method of claim 51 wherein the window function depends on the decoded pitch information for the subframe.

58. The method of claim 57 wherein the spectrum of the window function is approximately equal to zero at all nonzero multiples of the decoded pitch frequency of the subframe.

59. The method of claim 38 and wherein the voicing state information includes one or more voicing decisions, with each voicing decision determining the voicing state of a frequency region in the subframe.

60. The method of claim 59 wherein each voicing decision determines whether a frequency region in the subframe is voiced or unvoiced.

61. The method of claim 60 wherein the pulse locations are reinitialized if consecutive frames or subframes are predominately not voiced, and future determined pulse locations do not substantially depend on speech model parameters corresponding to frames or subframes prior to such reinitialization.

62. The method of claim 60 wherein each voicing decision further determines whether a frequency region in the subframe is pulsed.

63. The method of claim 60 wherein the selected voicing state is the voiced voicing state and the pulse locations depend at least in part on the decoded pitch information for the subframe.

64. The method of claim 63 wherein the pulse locations are reinitialized if consecutive frames or subframes are predominately not voiced, and future determined pulse locations do not substantially depend on speech model parameters corresponding to frames or subframes prior to such reinitialization.

65. The method of claim 63 wherein frequency responses of the first impulse response and the second impulse response correspond to the decoded spectral information in voiced frequency regions and the frequency responses are approximately zero in other frequency regions.

66. The method of claim 65 wherein each of the pulse locations corresponds to a time offset associated with each impulse in an impulse sequence, and the first signal samples are computed by convolving the first impulse response with the impulse sequence and the second signal samples are computed by convolving the second impulse response with the impulse sequence.

67. The method of claim 66 wherein the first signal samples and the second signal samples are combined by first multiplying each by a synthesis window function and then adding the two together.

68. The method of claim 62 wherein the selected voicing state is the pulsed voicing state, and the frequency response of the first impulse response and the second impulse response corresponds to the spectral information in pulsed frequency regions and the frequency response is approximately zero in other frequency regions.

69. The method of claim 60 wherein the first impulse response is computed by:

determining FFT coefficients for frequency regions where the voicing state equals the selected voicing state from the decoded model parameters for the subframe;

processing the FFT coefficients with an inverse FFT to compute first time-scaled signal samples;

interpolating and resampling the first time-scaled signal samples to produce first time-corrected signal samples; and multiplying the first time-corrected signal samples by a window function to produce the first impulse response.

70. The method of claim 69 wherein the interpolating and resampling the first time-scaled signal samples depends on the decoded pitch information of the first subframe.

71. The method of claim 70 wherein the pulse locations are reinitialized if consecutive frames or subframes are predominately not voiced, and future determined pulse locations do not substantially depend on speech model parameters corresponding to frames or subframes prior to such reinitialization.

72. The method of claim 69 wherein regenerated phase information is computed using the decoded model parameters for the subframe, and the regenerated phase information is used in determining the FFT coefficients for frequency regions where the voicing state equals the selected voicing state.

73. The method of claim 72 wherein the regenerated phase information is computed by applying a smoothing kernel to the logarithm of the spectral information.

74. The method of claim 72 wherein further FFT coefficients are set to approximately zero in frequency regions where the voicing state does not equal the selected voicing state.

75. The method of claim 74 wherein further FFT coefficients are set to approximately zero in frequency regions outside the bandwidth represented by decoded model parameters for the subframe.

76. The method of claim 69 wherein the window function depends on the decoded pitch information for the subframe.

77. The method of claim 76 wherein the spectrum of the window function is approximately equal to zero at all nonzero multiples of the decoded pitch frequency of the subframe.

78. A device comprising:

a microphone that produces an analog speech signal in response to detected speech;

an analog-to-digital converter connected to receive the analog speech signal from the microphone and produce a digital speech signal from the analog speech signal; and a speech processor connected to receive the digital speech signal, wherein the speech processor:

produces frames of speech model parameters from the digital speech signal, wherein a frame of speech model parameters includes pitch information, voicing information determining the voicing state in one or more frequency regions, and spectral information, computes a first digital filter using a first frame of speech model parameters, wherein the frequency response of the first digital filter corresponds to the spectral information in frequency regions where the voicing state equals the selected voicing state, computes a second digital filter using a second frame of speech model parameters, wherein the frequency response of the second digital filter corresponds to the spectral information in frequency regions where the voicing state equals the selected voicing state, determines a set of pulse locations, produces a set of first signal samples from the first digital filter and the pulse locations, produces a set of second signal samples from the second digital filter and the pulse locations, and combines the first signal samples with the second signal samples to produce a set of digital speech samples corresponding to the selected voicing state.

79. The device of claim 78 wherein the frequency response of the first digital filter and the frequency response of the second digital filter are zero in frequency regions where the voicing state does not equal the selected voicing state.

80. The device of claim 79 wherein:

the voicing information determines which frequency regions are voiced and which frequency regions are unvoiced, and the selected voicing state is the voiced voicing state and the pulse locations are computed such that the time between successive pulse locations is determined at least in part from the pitch information.

81. The device of claim 78 wherein the device comprises a mobile communications device.

82. A mobile communication device comprising:

a speech decoder that processes frames of speech model parameters from a digital speech signal, wherein a frame of speech model parameters includes pitch information, voicing information determining the voicing state in one or more frequency regions, and spectral information, and wherein the speech decoder:

computes a first digital filter using a first frame of speech model parameters, wherein the frequency response of the first digital filter corresponds to the spectral information in frequency regions where the voicing state equals the selected voicing state, computes a second digital filter using a second frame of speech model parameters, wherein the frequency response of the second digital filter corresponds to the spectral information in frequency regions where the voicing state equals the selected voicing state, determines a set of pulse locations, produces a set of first signal samples from the first digital filter and the pulse locations, produces a set of second signal samples from the second digital filter and the pulse locations, combines the first signal samples with the second signal samples to produce a set of digital speech samples corresponding to the selected voicing state, and uses the digital speech samples for the frame subframe corresponding to the selected voicing state to produce speech samples of a digital speech signal;

a digital-to-analog converter that receives the speech samples of the digital speech signal and converts the speech samples of the digital speech signal to an analog signal; and a speaker that receives the analog signal and converts the analog signal into an acoustic signal suitable for human listening.

83. The device of claim 82 wherein the frequency response of the first digital filter and the frequency response of the second digital filter are zero in frequency regions where the voicing state does not equal the selected voicing state.

84. The device of claim 83 wherein:

the voicing information determines which frequency regions are voiced and which frequency regions are unvoiced, and the selected voicing state is the voiced voicing state and the pulse locations are computed such that the time between successive pulse locations is determined at least in part from the pitch information.

85. The device of claim 82 wherein the device comprises a mobile communications device.

* * * * *